US007250928B2

(12) United States Patent
Yamazaki et al.

(10) Patent No.: US 7,250,928 B2
(45) Date of Patent: Jul. 31, 2007

(54) LIGHT EMITTING DEVICE, METHOD OF DRIVING A LIGHT EMITTING DEVICE, AND ELECTRONIC EQUIPMENT

(75) Inventors: Shunpei Yamazaki, Tokyo (JP); Jun Koyama, Kanagawa (JP); Mai Akiba, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 253 days.

(21) Appl. No.: 10/243,840

(22) Filed: Sep. 16, 2002

(65) Prior Publication Data

US 2003/0052843 A1 Mar. 20, 2003

(30) Foreign Application Priority Data

Sep. 17, 2001 (JP) ..... 2001-282331

(51) Int. Cl.
*G09G 3/30* (2006.01)
*G09G 3/32* (2006.01)
*G09G 3/10* (2006.01)

(52) U.S. Cl. ..... 345/76; 345/82; 315/169.3

(58) Field of Classification Search ..... 345/75.2, 345/76, 82, 204; 315/169.1, 169.3
See application file for complete search history.

(56) References Cited

U.S. PATENT DOCUMENTS 4,951,041 A 8/1990 Inada et al.
5,247,190 A 9/1993 Friend et al.

(Continued)

FOREIGN PATENT DOCUMENTS

CN 1 278 635 1/2001

(Continued)

OTHER PUBLICATIONS

S.A. Van Slyke et al.; "Organic Electroluminescent Devices With Improved Stability"; *Applied Physics Letters 69*(15); pp. 2160-2162; Oct. 7, 1996.

(Continued)

*Primary Examiner*—Richard Hjerpe
*Assistant Examiner*—M. Fatahiyar
(74) *Attorney, Agent, or Firm*—Fish & Richardson P.C.

(57) ABSTRACT

A light emitting device capable of preventing a luminance of individual light emitting elements from being fluctuated by applying electrical characteristics of TFTs for properly controlling current being fed to individual light emitting elements, and also capable of generating the constant luminance without adversely being affected by possible degradation of organic light emitting layers and variable temperature by way of preventing the luminance of light emitting elements from being lowered through degradation of organic light emitting layers. Instead of controlling the luminance of light emitting elements by means of a voltage applied to TFTs, by way of properly controlling current flowing into TFTs via a signal-line driving circuit, it is possible to hold on the current flowing into light emitting elements at a desired value without adversely being affected by electrical characteristics of TFTs. Further, a voltage biasing in an inverse direction is fed to light emitting elements per predetermined period of time. The above-described double means multiply such practical effects to more securely prevent the luminance from being lowered by possible degradation of organic light emitting layers, and make it possible to hold on such current flowing into light emitting elements at a desired value without being affected by electrical characteristics of TFTs.

31 Claims, 23 Drawing Sheets

U.S. PATENT DOCUMENTS

| | | | | |
|---|---|---|---|---|
| 5,399,502 | A | 3/1995 | Friend et al. | |
| 5,414,443 | A | 5/1995 | Kanatani et al. | |
| 5,552,678 | A | 9/1996 | Tang et al. | |
| 5,641,991 | A | 6/1997 | Sakoh | |
| 5,684,365 | A | 11/1997 | Tang et al. | |
| 5,748,160 | A | 5/1998 | Shieh et al. | |
| 5,882,761 | A | 3/1999 | Kawami et al. | |
| 5,952,789 | A | 9/1999 | Stewart et al. | |
| 5,990,629 | A | 11/1999 | Yamada et al. | |
| 6,023,259 | A | 2/2000 | Howard et al. | |
| 6,087,245 | A | 7/2000 | Yamazaki et al. | |
| 6,091,203 | A | 7/2000 | Kawashima et al. | |
| 6,175,345 | B1 | 1/2001 | Kuribayashi et al. | |
| 6,229,506 | B1 | 5/2001 | Dawson et al. | |
| 6,307,322 | B1 | 10/2001 | Dawson et al. | |
| 6,351,078 | B1 | 2/2002 | Wang et al. | |
| 6,366,116 | B1 | 4/2002 | Juang | |
| 6,373,454 | B1 | 4/2002 | Knapp et al. | |
| 6,373,455 | B1 | 4/2002 | Kuribayashi et al. | |
| 6,380,689 | B1 * | 4/2002 | Okuda | 315/169.3 |
| 6,452,341 | B1 | 9/2002 | Yamauchi et al. | |
| 6,486,606 | B1 | 11/2002 | Ting | |
| 6,501,227 | B1 | 12/2002 | Koyama | |
| 6,501,466 | B1 | 12/2002 | Yamagishi et al. | |
| 6,525,704 | B1 | 2/2003 | Kondo et al. | |
| 6,535,185 | B2 | 3/2003 | Kim et al. | |
| 6,580,657 | B2 * | 6/2003 | Sanford et al. | 365/230.05 |
| 6,583,581 | B2 | 6/2003 | Kaneko et al. | |
| 6,583,775 | B1 * | 6/2003 | Sekiya et al. | 345/76 |
| 6,661,397 | B2 * | 12/2003 | Mikami et al. | 345/76 |
| 6,693,385 | B2 | 2/2004 | Koyama | |
| 6,734,636 | B2 * | 5/2004 | Sanford et al. | 315/169.3 |
| 6,738,034 | B2 | 5/2004 | Kaneko et al. | |
| 6,777,710 | B1 | 8/2004 | Koyama | |
| 6,859,193 | B1 | 2/2005 | Yumoto | |
| 6,872,973 | B1 | 3/2005 | Koyama et al. | |
| 6,882,113 | B2 | 4/2005 | Kaneko et al. | |
| 2001/0022565 | A1 | 9/2001 | Kimura | |
| 2001/0045929 | A1 | 11/2001 | Prache et al. | |
| 2001/0055828 | A1 | 12/2001 | Kaneko et al. | |
| 2002/0089291 | A1 | 7/2002 | Kaneko et al. | |
| 2002/0135313 | A1 | 9/2002 | Koyama | |
| 2002/0180369 | A1 | 12/2002 | Koyama | |
| 2003/0062524 | A1 | 4/2003 | Kimura | |
| 2003/0117083 | A1 | 6/2003 | Koyama | |
| 2003/0214249 | A1 | 11/2003 | Kaneko et al. | |
| 2004/0085269 | A1 * | 5/2004 | Mikami et al. | 345/76 |
| 2004/0196219 | A1 | 10/2004 | Kaneko et al. | |
| 2004/0207615 | A1 | 10/2004 | Yumoto | |
| 2005/0162356 | A1 | 7/2005 | Koyama et al. | |
| 2005/0167691 | A1 | 8/2005 | Kaneko et al. | |
| 2005/0190177 | A1 | 9/2005 | Yumoto | |
| 2005/0200300 | A1 | 9/2005 | Yumoto | |

FOREIGN PATENT DOCUMENTS

| | | |
|---|---|---|
| EP | 0 704 912 A1 | 4/1996 |
| EP | 0 717 446 | 6/1996 |
| EP | 0 762 374 | 3/1997 |
| EP | 0 776 147 A1 | 5/1997 |
| EP | 0 883 191 | 12/1998 |
| EP | 1 061 497 | 12/2000 |
| EP | 1 087 366 | 3/2001 |
| EP | 1 094 436 A2 | 4/2001 |
| EP | 1 102 234 | 5/2001 |
| EP | 1 130 565 | 9/2001 |
| JP | 64-31197 | 2/1989 |
| JP | 8-78519 | 3/1996 |
| JP | 8-180972 | 7/1996 |
| JP | 08-234683 | 9/1996 |
| JP | 09-138659 | 5/1997 |
| JP | 9-148066 | 6/1997 |
| JP | 10-41068 | 2/1998 |
| JP | 10-214060 | 8/1998 |
| JP | 10-232649 | 9/1998 |
| JP | 10-312173 | 11/1998 |
| JP | 11-003048 | 1/1999 |
| JP | 11-282419 | 10/1999 |
| JP | 2000-040924 | 2/2000 |
| JP | 2000-056847 | 2/2000 |
| JP | 2000-138572 | 5/2000 |
| JP | 2000-180893 | 6/2000 |
| JP | 2000-267164 | 9/2000 |
| JP | 2000-268957 | 9/2000 |
| JP | 2000-347621 | 12/2000 |
| JP | 2001-042826 | 2/2001 |
| JP | 2001-060076 | 3/2001 |
| JP | 2001-109432 | 4/2001 |
| JP | 2001-147659 | 5/2001 |
| JP | 2001-159878 | 6/2001 |
| JP | 2001-222255 | 8/2001 |
| JP | 2001-324958 | 11/2001 |
| JP | 2002-091376 | 3/2002 |
| JP | 2002-207451 | 7/2002 |
| WO | WO 98/33165 | 7/1998 |
| WO | WO 99/065012 | 12/1999 |
| WO | WO01-006484 | 1/2001 |
| WO | WO 01/006484 | 1/2001 |

OTHER PUBLICATIONS

Zou et al.; Improvement of Current-Voltage Characteristics in Organic Light Emitting Diodes by Application of Reversed-Bias Voltage; *Japanese Journal of Applied Physics*, vol. 37, Part 2, No. 11B; pp. L1406-L1408; Nov. 15, 1998.

Bae et al.; "A Novel Pixel Design for an Active Matrix Organic Light Emitting Diode Display"; *SID 2000*; pp. 358-361; 2000.

Baldo et al.; "Highly efficient phosphorescent emission from organic electroluminescent devices"; *Nature*, vol. 395; pp. 151-154; Sep. 10, 1998.

Baldo et al.; "Very high-efficiency green organic light-emitting devices based on electrophosphorescence"; *Applied Physics Letters*, vol. 75(1); pp. 4-6; Jul. 5, 1999.

Chapter 6.7 MOS Differential Amplifiers; *Micro-Electronics Circuits* by Sedra/Smith Saunders College Publishing; pp. 447-456; 1991.

Dawson et al.; "A Poly-Si Active Matrix OLED Display with Integrated Drivers"; *SID 99 Digest*; pp. 438-441; 1999.

Dawson et al.; "Design of an Improved Pixel for a Polysilicon Active-Matrix Organic LED Display"; *SID 98 Digest*; pp. 11-14; 1998.

Dawson et al.; "The Impact of the Transient Response of Organic Light Emitting Diodes on the Design of Active Matrix OLED Displays"; *IEDM 98*; pp. 875-878; 1998.

Hunter et al.; "Active Matrix Addressing of Polymer Light Emitting Diodes Using Low Temperature Poly Silicon TFTs"; *AM-LCD 2000*; pp. 249-252; 2000.

Kimura et al.; "Low-Temperature Poly-Si TFT Display using Light-Emitting-Polymer"; *AM-LCD 2000*; pp. 245-248; 2000.

Tsutsui et al.; "High Quantum Efficiency in Organic Light-Emitting Devices with Iridium-Complex as a Triplet Emissive Center"; *Japanese Journal of Applied Physics*, vol. 38, Part 2, No. 12B; pp. L1502-L1504; Dec. 15, 1999.

Yumoto et al.; "Pixel-Driving Methods for Large-Sized Poly-Si AM-OLED Displays"; *Asia Display / IDW '01*; pp. 1395-1398; 2001.

T. Tsutsui et al., "Electroluminescence in Organic Thin Films," *Photochemical Processes in Organized Molecular Systems*, 1991, pp. 437-450.

Schenk et al., "Polymers for Light Emitting Diodes," *EURODISPLAY '99: Proceedings of the 19th IDRC* (*International Display Research Conference*, Sep. 6, 1999, pp. 33-37.

T. Tsutsui et al., "Electroluminescence in Organic Thin Films," *Photochemical Processes in Organized Molecular Systems*, 1991, pp. 437-450.

Schenk et al., "Polymers for Light Emitting Diodes," *EURODISPLAY '99: Proceedings of the 19th IDRC (International Display Research Conference*, Sep. 6, 1999, pp. 33-37.

Chinese Office Action (Application No. 200210051411.9), dated Aug. 11, 2006, 25 pages (with English translation).

* cited by examiner 357
358
359
360
361
362
365
355
380
356
A
A'
B
B'
366
370
369
368
367
375
371:PTFT
372:NTFT
373:Tr3
374:Tr2
DRIVING CIRCUIT
PIXEL PORTION

LIGHT EMITTING DEVICE, METHOD OF DRIVING A LIGHT EMITTING DEVICE, AND ELECTRONIC EQUIPMENT

BACKGROUND OF THE INVENTION

1. Field of the Invention

The present invention relates to an OLED panel in which an organic light emitting element formed on a substrate is enclosed between the substrate and a cover member. Also, the present invention relates to an OLED module in which an IC or the like is mounted on the OLED panel. Note that, in this specification, the OLED panel and the OLED module are generically called light emitting devices. The present invention further relates to a method of driving the light emitting device and an electronic appliance using the light emitting device.

2. Description of the Related Art

A light-emitting element emits light by itself, and thus, has high visibility. The light-emitting element does not need a backlight necessary for a liquid crystal display device (LCD), which is suitable for a reduction of a light-emitting device in thickness. Also, the light-emitting element has no limitation on a viewing angle. Therefore, the light-emitting device using the light-emitting element has recently been attracting attention as a display device that substitutes for a CRT or the LCD.

Incidentally, the light-emitting element means an element of which a luminance is controlled by electric current or voltage in this specification. The light emitting element includes an OLED (organic light emitting diode), an MIM type electron source element (electron emitting elements) used to a FED (field emission display) and the like.

The OLED includes a layer containing an organic compound in which luminescence generated by application of an electric field (electroluminescence) is obtained (organic light emitting material) (hereinafter, referred to as organic light emitting layer), an anode layer and a cathode layer. A light emission in returning to a base state from a singlet excitation state (fluorescence) and a light emission in returning to a base state from a triplet excitation state (phosphorescence) exist as the luminescence in the organic compound. The light-emitting device of the present invention may use one or both of the above described light emissions.

Note that, in this specification, all the layers provided between an anode and a cathode of the OLED are defined as the organic light emitting layers. The organic light emitting layers specifically include a light emitting layer, a hole injecting layer, an electron injecting layer, a hole transporting layer, an electron transporting layer and the like. These layers may have an inorganic compound therein. The OLED basically has a structure in which an anode, a light emitting layer, a cathode are laminated in order. Besides this structure, the OLED may take a structure in which an anode, a hole injecting layer, a light emitting layer, a cathode are laminated in order or a structure in which an anode, a hole injecting layer, a light emitting layer, an electron transporting layer, a cathode are laminated in order.

FIG. 23 exemplifies the constitution of an individual pixel of a conventional light emitting device. The conventional pixel shown in FIG. 23 includes TFTs (thin-film transistors) 50 and 51, a storage capacitor 52, and a light emitting element 53.

A gate of the TFT 50 is connected to a scanning line 55. Either of a source and a drain of the TFT 50 is connected to a signal line 54, and the other is connected to the gate of the TFT 51. The source of the TFT 51 is connected to a power supply 56, and the drain is connected to an anode of a light emitting element 53. A cathode of the light emitting element 53 is connected to a power supply 57. The storage capacitor 52 is provided in order to preserve a predetermined voltage between the gate and the source of the TFT 51.

When the TFT 50 is turned ON by a predetermined voltage of the scanning line 55, a video signal fed to the signal line 54 is delivered to the gate of the TFT 51. Upon the input of video signal, based on the voltage of the input video signal, the gate voltage (i.e., the potential difference between the gate and the source) of the TFT 51 is determined. Then, the drain current of the TFT 51 driven by the gate voltage thereof is fed to the light emitting element 53, thereby enabling the light emitting element 53 to emit light with the input current.

The TFT composed of polysilicon exerts a field-effect mobility higher than that of the TFTs composed of amorphous silicon, and it has a large amount of an ON current. Because of the above reasons, the TFT composed of polysilicon is better suited for forming the transistor components of a light emitting element panel.

However, even when forming the TFT by applying polysilicon, its electrical characteristics are by no means comparable to the electrical characteristics of a MOS transistor formed on a monocrystalline silicon substrate. For example, field-effect mobility of the TFT composed of polysilicon is rated to be equal to or lower than one tenth the field-effect mobility of monocrystalline silicon. Further, because of a certain defect generated in crystal grain boundaries, the characteristics of the TFT composed of polysilicon is easily subject to variation, which is a problem.

Referring to FIG. 23, when electrical characteristics such as a threshold value and the ON current of the TFT 51 are variable per pixel, even though a voltage of the video signal is the same, a magnitude of the drain current in the TFT 51 varies between individual pixels, thus resulting in the uneven luminance of the light emitting element 53.

When industrially and commercially providing such a light emitting device utilizing an OLED (organic light-emitting display), there was such a critical problem in terms of the short service duration of the OLED caused by degradation of organic light-emitting layers. Generally, an organic light-emitting material is vulnerable to water, oxygen, light, and heat, which expedite possible degradation of the organic light-emitting layers. More particularly, the degrading rate is dependent on the constitution of a device for driving a light emitting device, electrical characteristics of the organic light-emitting material, a material of electrodes, a condition in the manufacturing processes, and the method of driving the light-emitting device.

Even though the voltage applied to the organic light-emitting layers is constant, once degradation occurs in the organic light-emitting layers, the luminance of the OLED is lowered to result in an obscure image on a display panel.

Further, a temperature of the organic light-emitting layers is variable by the outside temperature and heat generated by an OLED panel itself. However, generally, actual value of current flowing through the OLED is variable by the temperature. More particularly, when the temperature of organic light-emitting layers rises while the voltage is constant, a greater amount of current flows into the OLED. Further, inasmuch as the current flowing into the OLED and the luminance of the OLED are in the proportional relationship, the greater the amount of current flowing into the OLED, the brighter the luminance of the OLED. In this way, the luminance of the OLED is variable by the temperature of organic light-emitting layers, and thus, it is quite difficult to display desired gradation. In consequence, relative to the rise of the temperature, a greater amount of current is consumed by the light-emitting device.

SUMMARY OF THE INVENTION

An object of the present invention is to fully solve the above-described problems by providing a light-emitting device, which is capable of preventing a luminance of the light emitting device from being varied by electrical characteristics of a thin film transistor (TFT), capable of preventing the luminance of a light-emitting device from being lowered by degradation of organic light-emitting layers, and capable of securing the constant luminance without adversely being affected by possible degradation of the organic light-emitting layers and a varied temperature.

Inventors of the present invention observed that, compared to a method of emitting light by way of preserving a certain voltage added to an OLED to be constant, a method of emitting light by way of preserving a certain amount of current flowing into the OLED could minimize possible lowering of luminance of the OLED caused by degradation of the organic light emitting layers. It should be noted that, henceforth, a current flowing into a light-emitting device is called a "drive current", whereas a voltage applied to the light-emitting device is called a "drive voltage" in the following description.

Inventors conceived that it might be possible to preserve a volume of the current flowing into light-emitting device at a desired constant value without being affected by characteristics of a TFT and also prevent the luminance of the OLED from being varied by degradation of the OLED itself by way of properly controlling the current flowing into the TFT via a signal-line driving circuit in place of a method of controlling the luminance of the light-emitting device by applying a voltage to the TFT.

As was previously introduced by a technical paper shown in "TSUTSUI T, JPN J Appl. Phys. Part 2, Vol. 37, No. 11B, Page L1406–L1408, 1998", it was detected that degradation of current/voltage characteristics of the light-emitting device can be decreased by applying a drive voltage bearing an inverse polarity to the light-emitting device per specific period of time. Utilizing the detected characteristics, in addition to the above-described constitution, the present invention provides a light-emitting device with such a voltage biasing in an inverse direction every specific period of time. Inasmuch as the light-emitting element corresponds to a diode, the light-emitting element emits light when a bias voltage is added in the normal direction, whereas it does not emit light when it receives the voltage biasing in an inverse direction.

As described above, by applying an AC-drive method for the light emitting device with which a drive voltage biasing in an inverse direction is applied every predetermined period, it is possible to minimize degradation of current/voltage characteristics of individual light emitting elements, and thus, it is possible to extend actual service life of individual light emitting elements as compared with cases where the conventional drive methods are used.

The above-described two-way constitutions provide multiplied effect, whereby making it possible to prevent the luminance of the OLED from being lowered by possible degradation of the organic light-emitting layers, and it is also possible to preserve volume of current flowing into the light-emitting elements at a desired constant value without adversely being affected by characteristics of the TFT.

Further, as described above, when an image is displayed per frame period via AC-current drive, the displayed pixel may visibly generate flicker. Because of this, when applying AC-current drive, it is desired that flicker be prevented from occurrence by way of driving a light emitting element with a frequency higher than that does not cause flicker to be generated visibly via DC-current drive to which only the normal directional bias voltage is applied.

By virtue of the above arrangement, unlike a conventional light emitting device shown in FIG. 23, in the present invention, it is possible to prevent the luminance of the light emitting elements from being varied between the pixels even when characteristics of a TFT for controlling the current fed to the light emitting elements are varied per pixel. Further, unlike the case of driving such a conventional TFT 51 comprising voltage-input type pixels shown in FIG. 23 in a linear region, it is possible to prevent the luminance from being lowered via degradation of the light emitting elements. Further, even when the temperature of the organic light emitting layers is affected by the outside temperature or heat generated by the light-emitting panel itself, it is still possible to prevent the luminance of the light emitting elements from being varied, and it is also possible to prevent the current from increasingly being consumed relative to the rise of the temperature.

In the light emitting device according to the present invention, a transistor used for composing the pixel may be a mono-silicon transistor, a thin-film transistor utilizing polysilicon or amorphous silicon, or a transistor utilizing an organic semiconductor.

Further, the transistors provided for the pixels of the light emitting device of the present invention may include a single-gate constitution, a double-gate constitution, or a multiple gate constitution incorporating more than the double-gate electrodes.

DETAILED DESCRIPTION OF THE PREFERRED EMBODIMENTS

Figure 1:
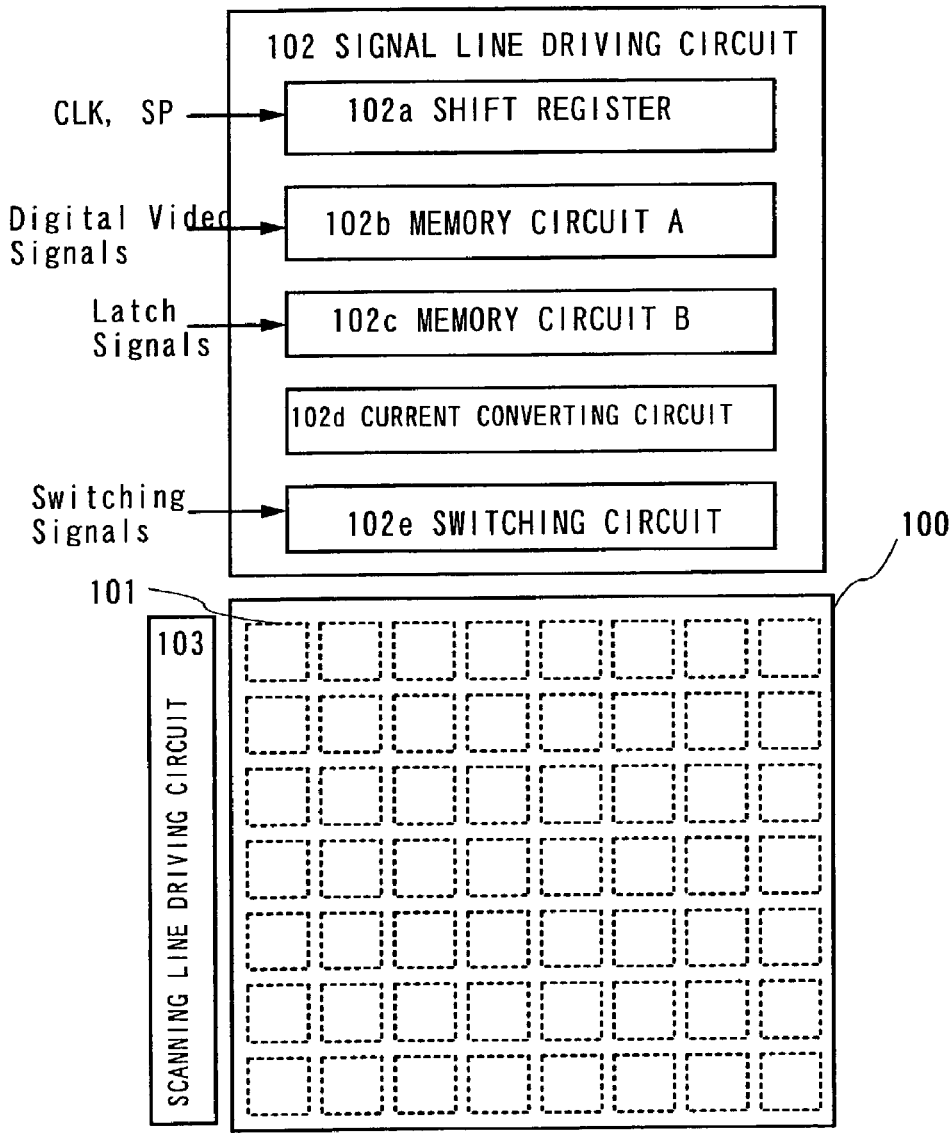
FIG. 1 is a block diagram of a light emitting device according to the present invention.

FIG. 1 is a block diagram for showing a structure of the light emitting device according to the present invention. Reference numeral 100 designates a pixel portion, in which a number of pixels 101 are disposed in a matrix shape. Reference numeral 102 designates a signal-line driving circuit. Reference numeral 103 designates a scanning line driving circuit.

In FIG. 1, the signal-line driving circuit 102 and the scanning-line driving circuit 103 are formed on an identical substrate loaded with the pixel portion 100. However, the scope of the present invention is not limited to the above arrangement. Alternatively, the arrangement may also be implemented, in which the signal-line driving circuit 102 and the scanning-line driving circuit 103 are formed on a substrate different from the one loaded with the pixel portion 100 and connected to the pixel portion 100 via a connector such as an FPC. In FIG. 1, each single unit of the signal-line driving circuit 102 and the scanning-line driving circuit 103 are provided. However, the scope of the present invention is not limited to this arrangement, but the number of the signal-line driving circuit 102 and the scanning-line driving circuit 103 may be defined by design engineers optionally.

Unless otherwise specifically defined, the term "connection" described in this specification means electrical connection, whereas the term "disconnection" means the state of not being connected.

Although not shown in FIG. 1, the pixel portion 100 is provided with a plurality of signal lines S1–Sx, power supply lines V1–Vx, and scanning lines G1–Gy. The numbers of the signal lines and the power supply lines are not always identical to each other. Further, it not always required to jointly provide both wirings, but, aside from these, other different wirings may also be provided.

It is possible for the signal-line driving circuit 102 to feed such an amount of the current compatible with the voltage of input video signal to individual signal lines S1–Sx. In the case of feeding a voltage biasing in an inverse direction to a light emitting element 104 shown in FIG. 2, the signal-line driving circuit 102 functions itself to apply to the gate of a corresponding TFT the voltage enough to turn ON the TFT for controlling the magnitude of the current or voltage that should be fed to the light emitting element 104. More particularly, in the present invention, the signal-line driving circuit 102 comprises the following: a shift register 102*a*, a memory circuit A 102*b* for storing a digital video signal, a memory circuit B 102*c*, a current converting circuit 102*d* for generating current compatible with a voltage borne by the digital video signal by applying a constant current supply source, and a switching circuit 102*e* which feeds the generated current to a signal line, and applies a voltage enough to turn ON a TFT for controlling the magnitude of current or voltage fed to the light emitting element 104 only during a period of applying a voltage biasing in an inverse direction to the light emitting element 104. It should be understood that the constitution of the signal-line driving circuit 102 built in the light emitting device of the present invention is not limited to the one described above. Although FIG. 1 exemplifies the signal-line driving circuit 102 compatible with a digital video signal, the scope of the signal-line driving circuit of the present invention is not limited to the one just cited above, but the signal-line driving circuit of the present invention may also be compatible with an analog video signal as well.

It should be noted that, unless otherwise specifically defined, the term "voltage" described in this specification means the difference of potential against ground potential.

Figure 2:
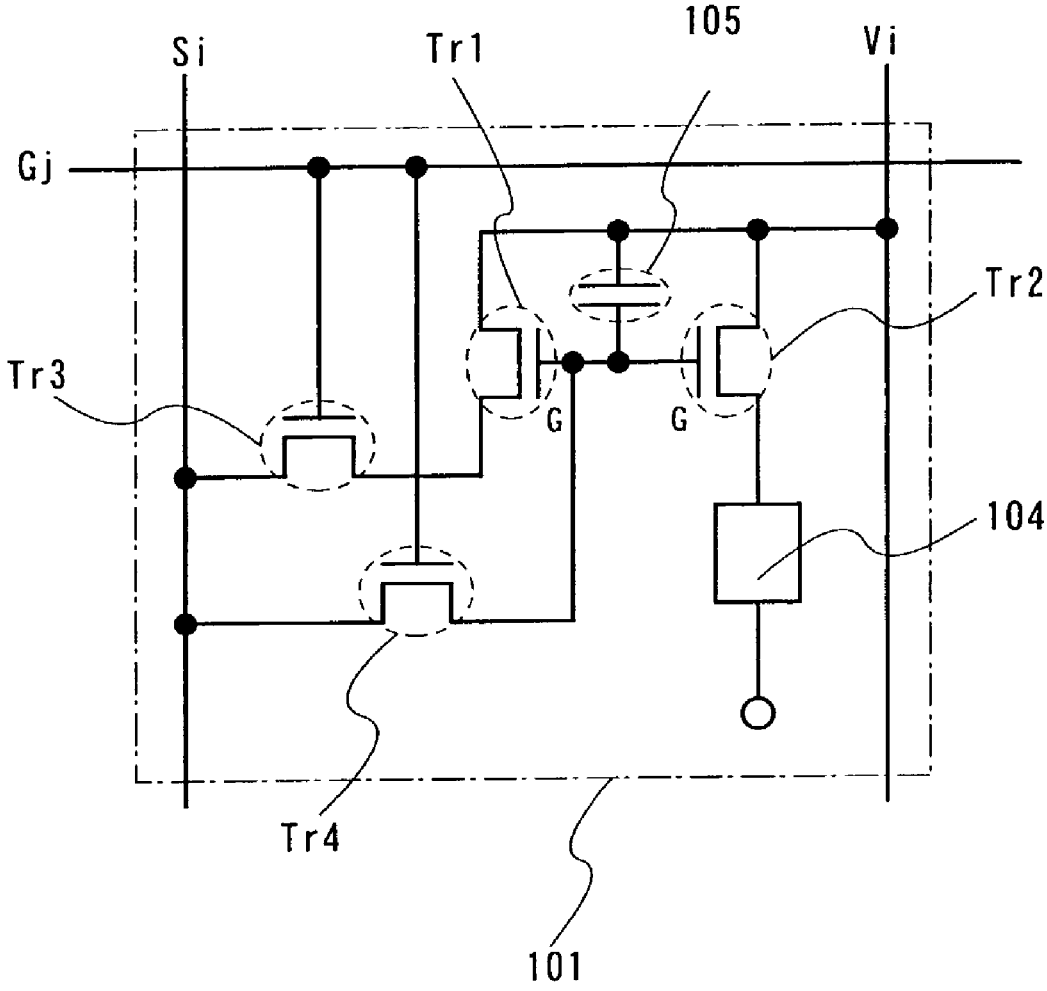
FIG. 2 is a block diagram of a pixel circuit of the light emitting device according to the present invention.

FIG. 2 shows a detailed structure of the pixel 101 shown in FIG. 1. The pixel 101 shown in FIG. 2 comprises a signal line Si being one of the signal-line components S1–Sx, a scanning line Gj being one of the scanning line components G1–Gy, and a power-supply line Vi being one of the power-supply line components V1–Vx. In addition, the pixel 101 further comprises transistors Tr1, Tr2, Tr3, and Tr4, a light emitting element 104, and a storage capacitor 105. The storage capacitor 105 is provided in order to hold more securely on a predetermined gate voltage between the gates and sources of the transistors Tr1 and Tr2. However, provision of the storage capacitor 105 is not always required.

The gate of the transistor Tr3 is connected to the scanning line Gj. Either of the source and the drain of the transistor Tr3 is connected to the signal line Si, whereas the other is connected to a second terminal of the transistor Tr1, where one of the source and the drain of the transistor Tr3 is defined as a first terminal, and the other is defined as a second terminal.

The gate of the transistor Tr4 is connected to the scanning line Gj. One of a first terminal and a second terminal of the transistor Tr4 is connected to one of the signal line Si and a second terminal of the first transistor Tr1, and the other is connected to the gates of the transistors Tr1 and Tr2.

The gates of the transistors Tr1 and Tr2 are connected to each other. First terminals of the transistors Tr1 and Tr2 are respectively connected to the power supply line Vi. A second terminal of the transistor Tr2 is connected to a pixel electrode of the light emitting element 104. One of a pair of electrodes provided in the storage capacitor 105 is connected to the gates of the transistors Tr1 and Tr2, and the other is connected to the power supply line Vi.

The light emitting element 104 incorporates an anode and a cathode. It should be understood that, in this specification, when the anode is utilized as the pixel electrode, the cathode is referred to as an opposing electrode, whereas in such a case in which the cathode is utilized as the pixel electrode, the anode is referred to as an opposing electrode. Voltages in the opposing electrodes are respectively held at a constant magnitude.

Note that the transistors Tr1 and Tr2 may be an n-channel type transistor or a p-channel type transistor. However, the transistors Tr1 and Tr2 are respectively provided with an identical polarity. In the case where the anode is utilized as the pixel electrode and the cathode is utilized as the opposing electrode, it is desirable that the transistors Tr1 and Tr2 be the p-channel type transistors. Conversely, in the case where the anode is utilized as the opposing electrode and the cathode is utilized as the pixel electrode, it is desirable that the transistors Tr1 and Tr2 be the n-channel type transistors.

The above transistors Tr3 and Tr4 may be of an n-channel or p-channel type respectively. The transistors Tr3 and Tr4 are respectively provided with an identical polarity.

Figure 3A:
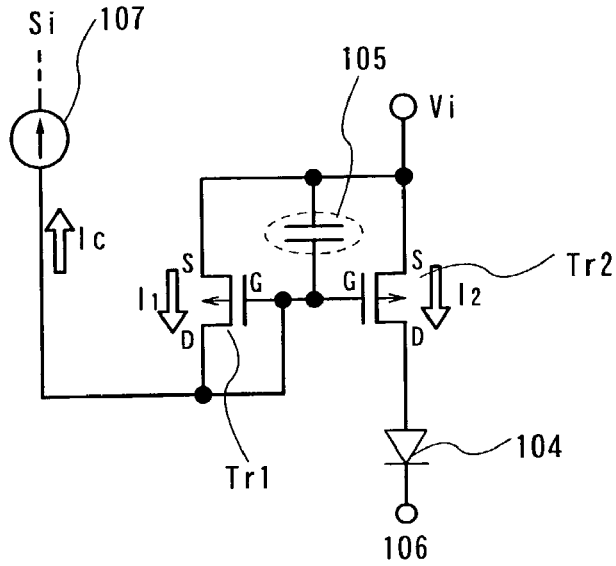
FIGS. 3A to 3C are respectively a schematic diagram of a pixel when being driven.
Figure 3B:
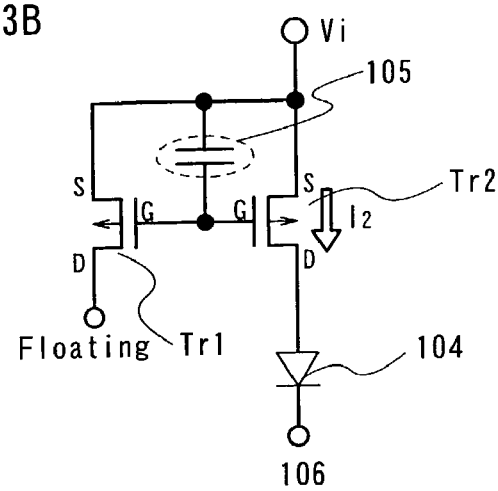
Figure 3C:
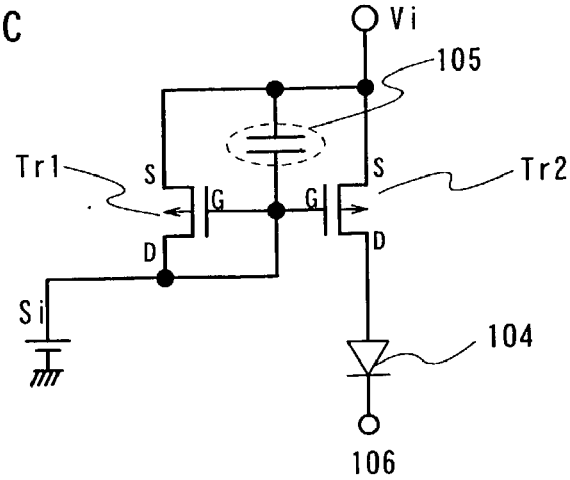

Next, referring now to FIGS. 3A to 3C, serial operations of the light emitting device according to a practical form of implementing the present invention are described below. Operations of the light emitting device according to the present invention are described by way of separating into a write in period Ta, a display period Td, and an inverse biasing period Ti per pixel present in respective lines. FIGS. 3A to 3C briefly exemplify the connecting relationship between the transistors Tr1 and Tr2, and the light emitting element 104 while the operating periods are underway. Concretely, FIGS. 3A to 3C exemplify such a case in which the transistors Tr1 and Tr2 respectively function as the p-channel type TFT and anode of the light emitting element 104 is utilized as a pixel electrode.

First, when the write in period Ta is entered in the pixels of individual lines, actual voltages of the power supply lines V1–Vx are held at a magnitude enough to allow the normal directional bias current to flow into the light emitting element 104 when the transistor Tr2 is turned ON. FIG. 1 shows a constitution of the light emitting device for displaying a monochromatic image. However, the present invention may also provide a light emitting device for displaying a color image. In that case, it is not necessary for all the voltages of the power supply lines V1 to Vx to be held at the same level, but they may be changed for each corresponding color.

Next, the scanning line driving circuit 103 serially selects scanning lines in respective lines to cause the transistors Tr3 and Tr4 to be turned ON. It is such arranged that individual periods for selecting respective scanning lines do not coincide with each other. Next, based on a video signal fed to the signal-line driving circuit 102, current (hereinafter, referred to as a signal current Ic) corresponding to the input video signal flows between the signal lines S1–Sx and the power supply lines V1–Vx.

FIG. 3A is a schematic diagram of the pixel 101 when the signal current Ic corresponding to the input video signal flows into the signal line Si while the write in period Ta is underway. Reference numeral 106 designates a terminal connected to a power supply for feeding a predetermined voltage to an opposing electrode. Reference numeral 107 designates a constant-current supply source provided for the signal-line driving circuit 102.

While the transistor Tr3 is ON, signal current Ic corresponding to input video signal flows into the signal line Si and then it also flows between the drain and the source of the transistor Tr1. When this condition is entered, since the gate and the drain of the transistor Tr1 are connected to each other, the transistor Tr1 is operated in a saturated region in accordance with an equation 1 shown below, where $V_{GS}$ designates a gate voltage, μ, designates mobility, $C_o$ designates a gate capacity per unit area, W/L designate the ratio of the width W to the length L of channels in the channel forming region, $V_{TH}$ designates a threshold value, and a drain current is defined to be I.

$$I=\mu C_o W/L\ (V_{GS}-V_{TH})^2/2 \qquad \text{Equation 1}$$

In the above equation 1, symbols μ, Co, W/L, and $V_{TH}$ are the stationary values determined by individual transistors. It is understood from the equation 1 that the gate voltage $V_{GS}$ of the transistor Tr1 is determined by the current value Ic.

The gate of the transistor Tr2 is connected to the gate of the transistor Tr1. Likewise, the source of the transistor Tr2 is connected to the source of the transistor Tr1. Accordingly, the gate voltage of the transistor Tr1 directly becomes the gate voltage of the transistor Tr2, whereby the drain current of the transistor Tr2 is proportional to the drain current of the transistor Tr1. In particular, when the value of μCoW/L is equal to that of $V_{TH}$, the drain current of the transistor Tr1 is also equal to that of the transistor Tr2, where this relationship is defined as $I_2$=Ic.

Then, the drain current $I_2$ of the transistor Tr2 flows into the light emitting element 104. The magnitude of the drain current flowing into the light emitting element 104 corresponds to that of the signal current Ic determined by the constant current supply source 107. Accordingly, the light emitting element 104 emits light with a luminance corresponding to the magnitude of the flowing current. If the current flowing into the light emitting element 104 is substantially close to zero or the current flows in an inversely biasing direction, the light emitting element 104 does not emit light at all.

Upon the termination of the write in period Ta, a process for selecting scanning lines per line is also terminated. Upon the termination of the write in period Ta in the pixels aligned in respective lines, the display period Td is entered in the pixels aligned in respective lines. FIG. 3B schematically exemplifies the operating condition of a pixel while the display period Td is underway, in which the transistors Tr3 and Tr4 are respectively OFF. In this condition, source regions of the transistors Tr3 and Tr4 are respectively connected to the power supply line Vi and held at a constant power-supply voltage.

While the display period Td is underway, the drain region of the transistor Tr1 is in the floating condition in which no potential is given from the other wirings and power supply. On the other hand, the value of $V_{GS}$ set during the write in period Ta in the transistor Tr2 still remains as it is. Because of this, the value of the drain current $I_2$ in the transistor Tr2 is still held at Ic. Accordingly, while the display period Td is underway, the organic light emitting display OLED 104 continuously emits light based on the luminance corresponding to the magnitude of the current predetermined during the write in period Ta.

Immediately after termination of the write in period Ta, the display period Td compulsorily appears. On the other hand, immediately after termination of the display period Td, either the ensuing write in period Ta or the inversely biasing period Ti appears.

When the inverse biasing period Ti is entered, actual voltage in the power supply lines V1–Vx is held at such a level corresponding to the case of feeding a voltage biasing in an inverse direction to the light emitting element 104 when the transistor Tr2 is turned on. Next, by causing the scanning line driving circuit 103 to serially select scanning lines in respective lines, the transistors Tr3 and Tr4 are turned ON, whereby enabling the signal-line driving circuit 102 to apply to the signal lines S1–Sx a voltage enough to turn the transistor Tr2 ON.

FIG. 3C schematically exemplifies the operating condition of the pixel 101 while the inverse biasing period Ti is underway. While the inverse biasing period Ti is underway, the transistor Tr2 is turned ON to enable a voltage of the power supply line Vi to be supplied to a pixel electrode of the light emitting element 104. This in turn causes a voltage biasing in an inverse direction to be applied to the light emitting element 104. As described earlier, when the voltage biasing in an inverse direction is input, the light emitting element 104 is prevented from emitting light.

It is suggested that the magnitude of the voltage in the power supply lines may correspond to that of the voltage biasing in an inverse direction fed to a light emitting element. By way of considering a duty ratio, in other words, considering proportion of a sum of the display duration per frame period, it is possible for design engineers to properly set duration of the inverse biasing period.

In the case of applying the digital driving method, i.e., the method of driving time gradation using a digital video signal, by way of enabling the write in period Ta and the display period Td corresponding to the digital video signals per individual bit to repeatedly appear one after another, it is possible to display an individual image. For example, when displaying an image by applying n-bit video signals, at lease n-units of the write in periods and n-units of the display periods are accommodated in each frame period, where n-units of the write in periods (Ta1–Tan) and n-units of the display periods (Td1–Tdn) individually correspond to individual bits of the digital video signal.

For example, following the write in period Tam (m designates an optional number among 1 to n), a display period corresponding to an identical bit number, i.e., a display period Tdm in this case, appears. By combining the write in period Ta with the display period Td, a sub-frame period SF is formed. Such a sub-frame comprising the write in period Tam and the display period Tdm corresponding to the m-th bit is defined as SFm.

In the case of utilizing digital video signal, the inverse biasing period Ti may be set immediately after terminating the display periods Td1–Tdn or immediately after terminating a display period finally appeared in a frame period among the display periods Td1–Tdn. It is not always required to compulsorily provide the inverse biasing period Ti per frame period, but instead, the inverse biasing period Ti may also be generated per several frames. It is possible for design engineers to properly set the number and the time of generating the inverse biasing periods Ti.

Figure 4:
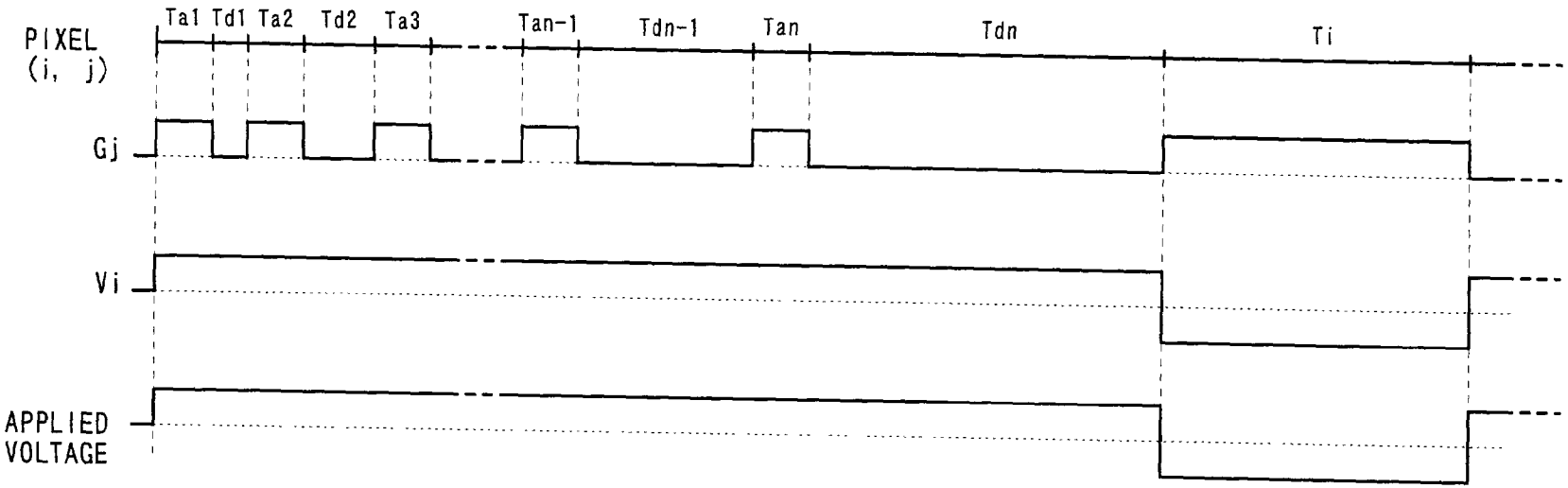
FIG. 4 exemplifies a timing chart of a voltage added to a scanning line and a power supply line.

FIG. 4 exemplifies a timing chart of the voltage applied to scanning lines in a pixel (i,j), the voltage applied to power supply lines, and the voltage applied to a light emitting element at the time when the inverse biasing period Ti appeared at the last moment of one-frame period. In the timing chart shown in FIG. 2, the transistors Tr1 and 2 are both composed of p-channel type TFTs, and the transistors Tr3 and Tr4 are both composed of n-channel type TFTs. The scanning line Gj is selected while respective write in periods Ta1–Tan and the inverse biasing period Ti were underway, in which the transistors Tr3 and Tr4 are turned ON. On the other hand, when the display periods Td1–Tdn are underway, the scanning line Gj is not selected, and thus, the transistors Tr3 and Tr4 are OFF. While the write in periods Ta1–Tan and the display periods Td1–Tdn are underway, an actual voltage of the power supply line Vi is held at such a magnitude just enough to allow the normal-directional biasing current to flow into the light emitting element 104 while the transistor Tr2 is ON. On the other hand, while the inverse biasing period Ti is underway, an actual voltage of the power supply line Vi is held at such a magnitude just enough to allow the current biased in an inverse direction to flow into the light emitting element 104. The voltage applied to the light emitting element 104 is held in the normal bias direction while the write in periods Ta1–Tan and the display periods Td1–Tdn are underway, and the voltage is held in the inversely biasing direction during the inverse biasing period Ti.

Duration of the sub-frame periods SF1–SFn suffices a formula expressed below.

$$SF1:SF2:\ldots:SFn=2^0:2^1:\ldots:2^{n-1}$$

While any of the sub-frame periods is underway, whether the corresponding light emitting element should emit light or not is selected by individual bits of the digital video signal. The gradation number is also controllable by way of controlling the sum of the display periods during one-frame period of light emission.

In order to improve image quality on the display, it is also possible to split a sub-frame period with a long display duration into plural parts. A concrete method of splitting the sub-frame period is disclosed in the Japanese Patent Application No. 2002-149113, and thus, it is possible to learn this method by referring thereto.

It is also allowable to display gradation in combination with area gradation.

In the case of displaying gradation by applying the analog video signal, simultaneously with the termination of the write in period Ta and the display period Td, one-frame period is terminated. An image is displayed during one-frame period. Then, the following frame period is entered, in which the write in period Ta is initiated to repeatedly execute the above-described serial processes.

In the case of utilizing the analog video signal, the inverse biasing period Ti is set immediately after the display period Td. It should be noted, however, that provision of the inverse biasing period Ti per frame period is not always required, but it is also allowable to cause the period Ti to appear every several-frame period. The timing to cause the inverse biasing period Ti to appear may properly be set by design engineers.

Figure 23:
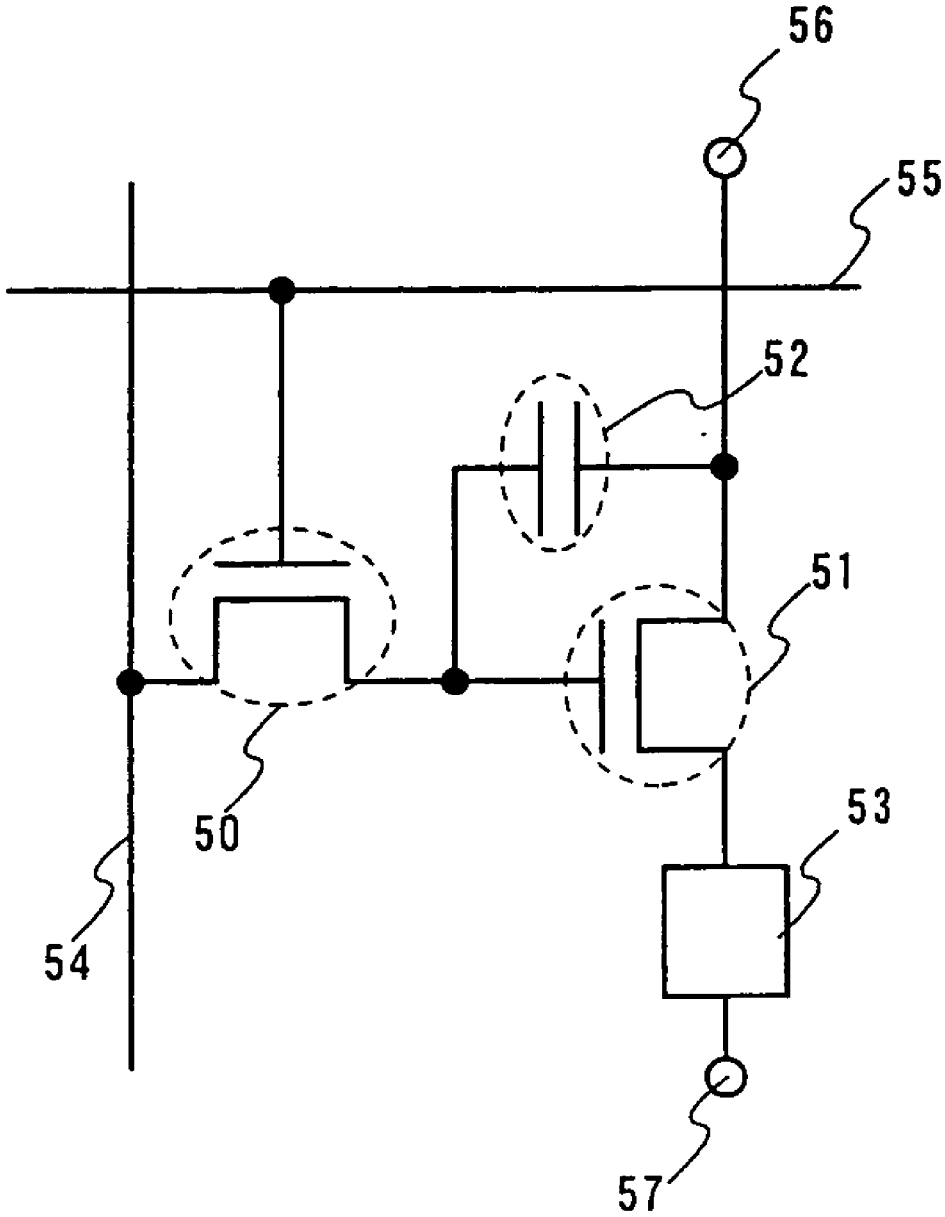
FIG. 23 (PRIOR ART)
FIG. 23 exemplifies a circuit diagram of a conventional pixel driving unit.

According to the present invention, unlike such a conventional light emitting device shown in FIG. 23, even when characteristics of the transistor Tr2 varies per pixel, the light emitting device of the present invention can securely prevent variation of the luminance from being generated between individual light emitting elements. Further, compared to such a case in which the TFT 51 of a conventional voltage-input type pixel shown in FIG. 23 is operated in a linear region, it is possible for the invention to prevent the luminance from being lowered by possible degradation of the light emitting element. Further, even when the temperature in the organic light emitting layers is affected by the outside temperature or the heat generated by the light emitting panel itself, it is also possible to prevent the luminance of the light emitting elements from varying, and further prevents the current from increasingly being consumed relative to the rise of temperature.

In a practical form for implementing the present invention, either of the first terminal and the second terminal of the transistor Tr4 is connected to the signal line Si, and the other is connected to the gates of the transistors Tr1 and Tr2. However, the scope of the embodiment is not limited to the constitution. In the pixel of the present invention, it is suggested that the transistor Tr4 should be connected to other elements or wirings in order that the gate of the above transistor Tr1 can be connected to the second terminal of the transistor Tr4 while the write in period Ta is underway and then the gate of the transistor Tr1 can be disconnected from the second terminal of the transistor Tr4 while the display period Td is underway. In other words, it is suggested that: while the write in period Ta is underway, the transistors Tr3 and Tr4 should be connected to each other as shown in FIG. 3A; while the display period Td is underway, the transistors Tr3 and Tr4 should be connected to each other as shown in FIG. 3B; and while the inverse biasing period Ti is underway, the transistors Tr3 and Tr4 should be connected to each other as shown in FIG. 3C.

Embodiments

Next, embodiments of the present invention are described below.

[Embodiment 1]

Figure 5:
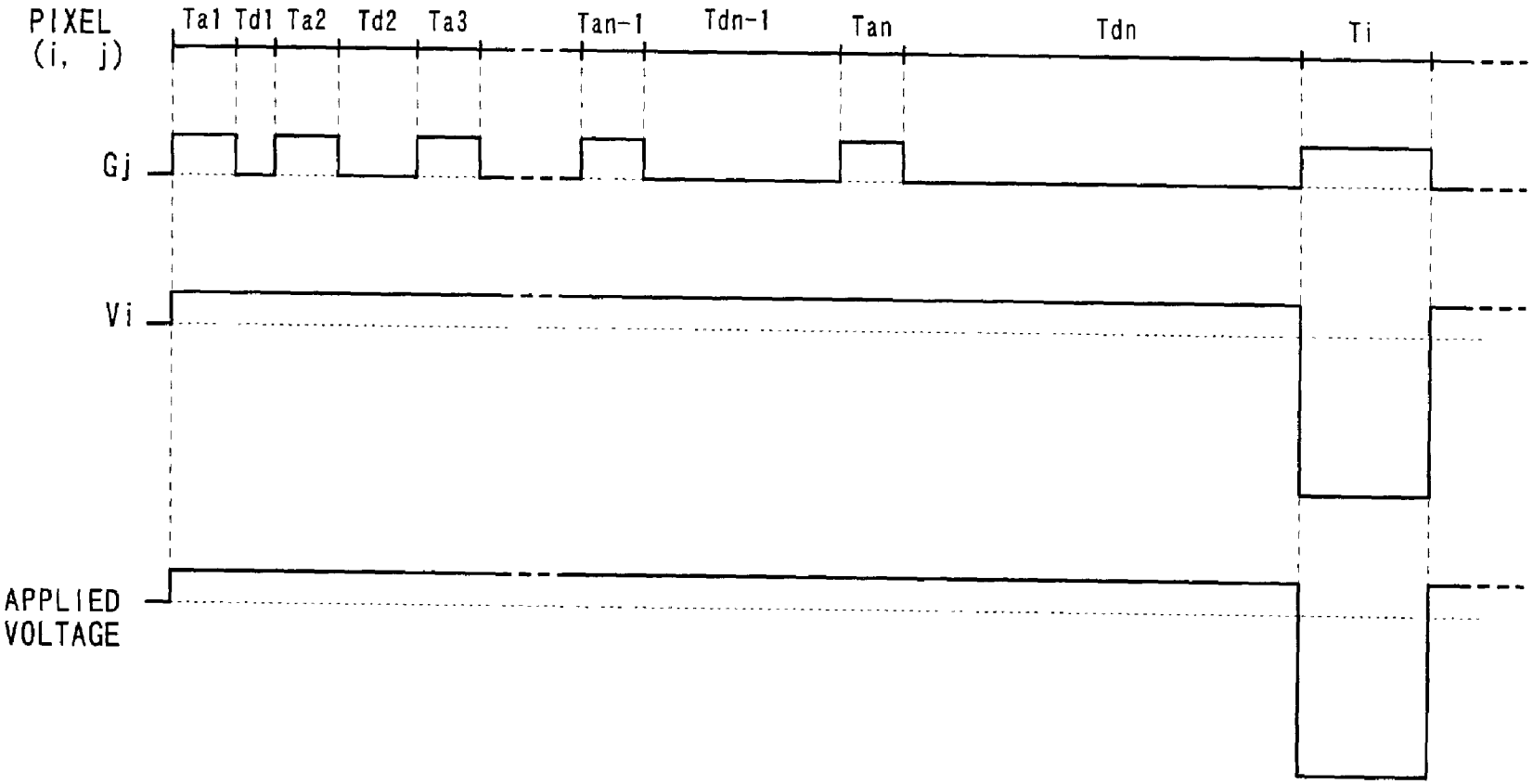
FIG. 5 exemplifies another timing chart of a voltage added to a scanning line and a power supply line.

Taking a pixel shown in FIG. 2 for example, description on this embodiment refers to a case in which the inverse biasing period Ti is made to appear based on a timing that differs from that shown in FIG. 4. Referring now to FIG. 5, a drive method according to this embodiment is described below.

FIG. 5 exemplifies a timing chart of a voltage added to individual scanning lines, a voltage added to the power supply line, and a voltage fed to a light emitting element in a pixel (i,j) in this embodiment. FIG. 5 exemplifies a case in which the transistors Tr1 and Tr2 are both composed of p-channel type TFTs, whereas the transistors Tr3 and Tr4 are both composed of n-channel type TFTs.

It is defined that the total length comprising the write in periods Ta1–Tan and the display periods Td1–Tdn corresponds to T_1 and a potential difference between the power supply line Vi and an opposing electrode of the light emitting element during the writing and display periods is expressed as V_1. Further, duration of the inverse biasing period Ti is expressed in terms of T_2, whereas the potential difference between the power supply line Vi and an opposing electrode of the light emitting element during the inverse biasing period Ti is expressed in terms of V_2. In this embodiment, the voltage of the power supply line Vi is held at such a magnitude corresponding to an equation shown below.

$$T_1 \times V_1 = T_2 \times V_2$$

Further, the voltage of the power supply line Vi is held at such a magnitude just enough to enable the light emitting element 104 to receive the voltage biasing in an inverse direction.

It is conceived that, by causing certain ionic impurities present in organic light emitting layers to be deposited on the side of one of electrode components, a portion bearing a certain resistance value lower than that of other portions is formed in part of the organic light emitting layers to cause current to intensely flow into the low-resistance portion, whereby expediting degradation of the organic light emitting layers. According to the present invention, it is possible to prevent such ionic impurities from being deposited on one of electrode components by applying an inverted drive method, thus further preventing the organic light emitting layers from incurring unwanted degradation. In particular, in this embodiment of the present invention, based on the above-described constitution, rather than merely applying the inverted drive method, it is possible to prevent ionic impurities from solely being deposited on one of electrode components, whereby more securely preventing the organic light emitting layers from incurring unwanted degradation.

[Embodiment 2]

Figure 6:
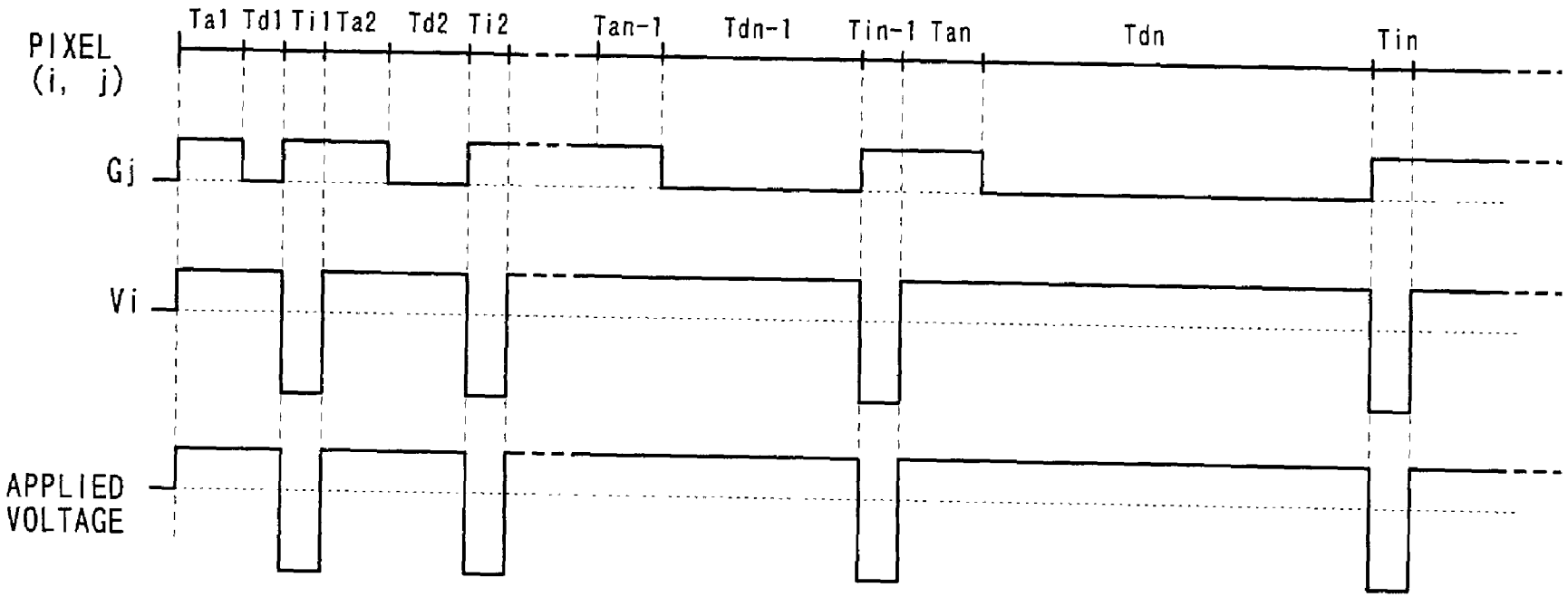
FIG. 6 exemplifies another timing chart of a voltage added to a scanning line and a power supply line.

Taking a pixel shown in FIG. 2 for example, description on this embodiment refers to a case in which the inverse biasing period Ti is made to appear based on a timing that differs from those shown in FIGS. 4 and 5. Referring now to FIG. 6, a drive method according to this embodiment is described below.

FIG. 6 exemplifies a timing chart of a voltage added to individual scanning lines, a voltage added to the power supply line, and a voltage fed to a light emitting element in a pixel (i,j) in this embodiment. FIG. 6 exemplifies a case in which the transistors Tr1 and Tr2 are both composed of p-channel type TFTs, whereas the transistors Tr3 and Tr4 are both composed of n-channel type TFTs.

In this embodiment, immediately after termination of individual display periods Td1–Tdn, in other words, immediately after terminating individual sub-frame periods, the inverse biasing periods Ti1–Tin respectively appear. For example, while the m-th sub-frame period SFm remains (where m corresponds to an optional number among 1–n of numbers), immediately after terminating the write in period Tam, the display period Tdm appears. It is so arranged that the inverse biasing period Tim appears immediately after terminating the display period Tdm.

In this embodiment, it is such arranged that individual durations of the inverse biasing periods Ti1–Tin are exactly identical to each other, and yet, an identical magnitude of voltage of the power supply line Vi is fed during all the operating periods. However, the scope of the present invention is not limited to the above arrangement. Duration of individual inverse biasing periods Ti1–Tin and applicable voltage may optionally be set by design engineers.

[Embodiment 3]

Figure 7:
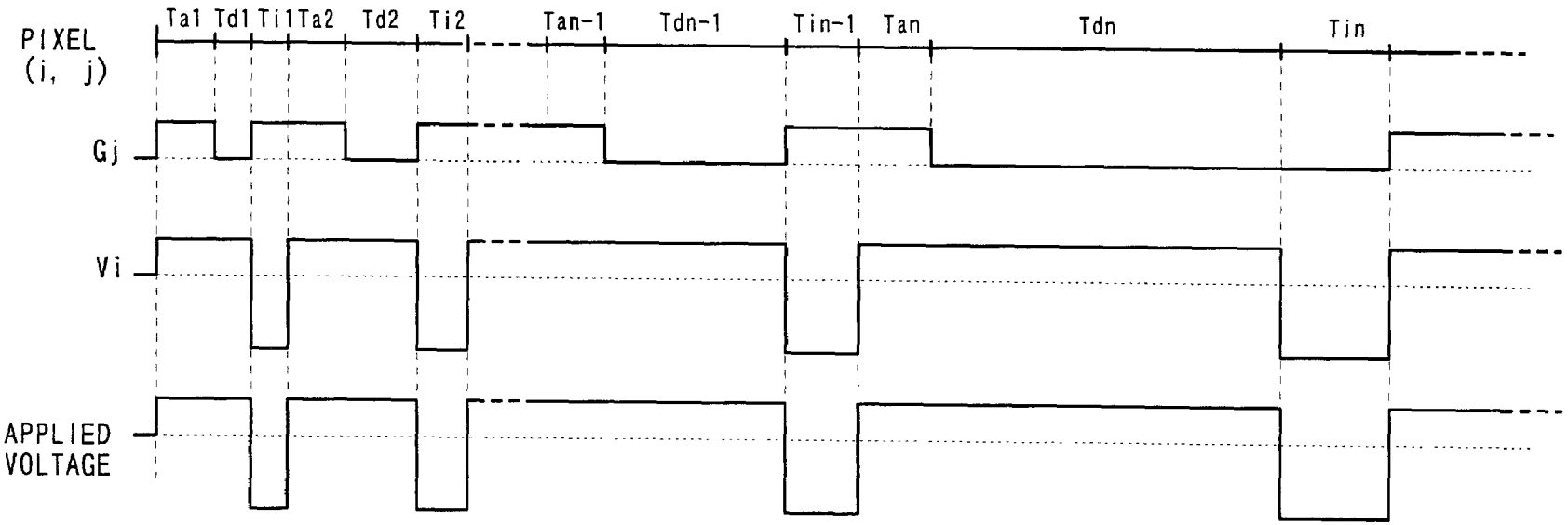
FIG. 7 exemplifies another timing chart of a voltage added to a scanning line and a power supply line.

Taking a pixel shown in FIG. 2 for example, description on this embodiment refers to a case in which the inverse biasing period Ti is made to appear based on a timing that differs from those shown in FIGS. 4 to 6. Referring now to FIG. 7, a drive method according to this embodiment is described below.

FIG. 7 exemplifies a timing chart of a voltage added to individual scanning lines, a voltage added to the power supply line, and a voltage fed to a light emitting element in a pixel (i,j) in this embodiment. FIG. 7 exemplifies a case in which the transistors Tr1 and Tr2 are both composed of p-channel type TFTs, whereas the transistors Tr3 and Tr4 are both composed of n-channel type TFTs.

In this embodiment, immediately after termination of individual display periods Td1–Tdn, in other words, immediately after terminating individual sub-frame periods, the inverse biasing periods Ti1–Tin respectively appear. For example, while the m-th sub-frame period SFm remains (where m is an arbitrary number of 1 to n), immediately after terminating the write in period Tam, the display period Tdm appears. Thus, the inverse biasing period Tim appears immediately after terminating the display period Tdm.

Further, in this embodiment, it is so arranged that the longer the duration of the display period that appears immediately before the inverse biasing periods, the greater the absolute value of potential difference between a voltage of the power supply line Vi and a voltage of an opposing electrode of the light emitting element during individual inverse biasing periods. Identical duration lasts in the individual inverse biasing periods Ti1–Tin. By virtue of the above arrangement, it is possible to prevent degradation of the organic light emitting layers more effectively than in pixels shown in FIGS. 4 to 6.

[Embodiment 4]

Figure 8:
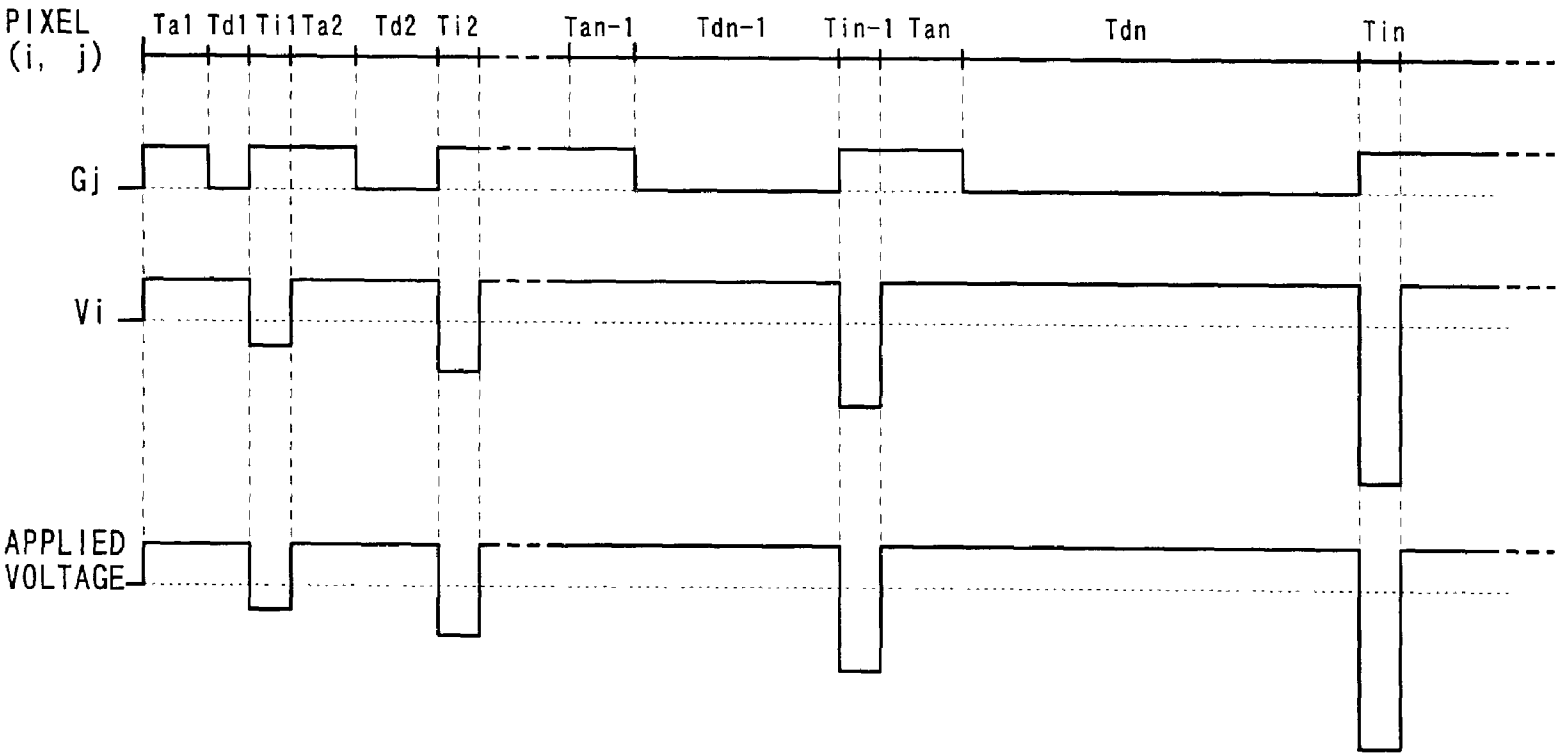
FIG. 8 exemplifies another timing chart of a voltage added to a scanning line and a power supply line.

Taking a pixel shown in FIG. 2 for example, description on this embodiment refers to a case in which the inverse biasing period Ti is made to appear based on a timing that differs from those shown in FIGS. 4 to 7. Referring now to FIG. 8, a drive method according to this embodiment is described below.

FIG. 8 exemplifies a timing chart of a voltage added to individual scanning lines, a voltage added to the power supply line, and a voltage fed to a light emitting element in a pixel (i,j) in this embodiment. FIG. 8 exemplifies a case in which the transistors Tr1 and Tr2 are both composed of p-channel type TFTs, whereas the transistors Tr3 and Tr4 are both composed of n-channel type TFTs.

In this embodiment, immediately after termination of individual display periods Td1–Tdn, in other words, immediately after terminating individual sub-frame periods, the inverse biasing periods Ti1–Tin respectively appear. For example, while the m-th sub-frame period SFm remains (where m is an arbitrary number of 1 to n), immediately after terminating the write in period Tam, the display period Tdm appears. Thus, the inverse biasing period Tim appears immediately after terminating the display period Tdm.

Further, in this embodiment, it is so arranged that the longer the duration of the display period that appears immediately before the inverse biasing periods, the greater the absolute value of potential difference between a voltage of the power supply line Vi and a voltage of an opposing electrode of the light emitting element during individual inverse biasing periods. Identical duration lasts in the individual inverse biasing periods Ti1–Tin. By virtue of the above arrangement, it is possible to prevent degradation of the organic light emitting layers more effectively than in pixels shown in FIGS. 4 to 6.

[Embodiment 5]

The following description refers to the constitutions of a signal-line driving circuit and a scanning line driving circuit provided for the light emitting device of the present invention, which is driven by a digital video signal.

Figure 9:
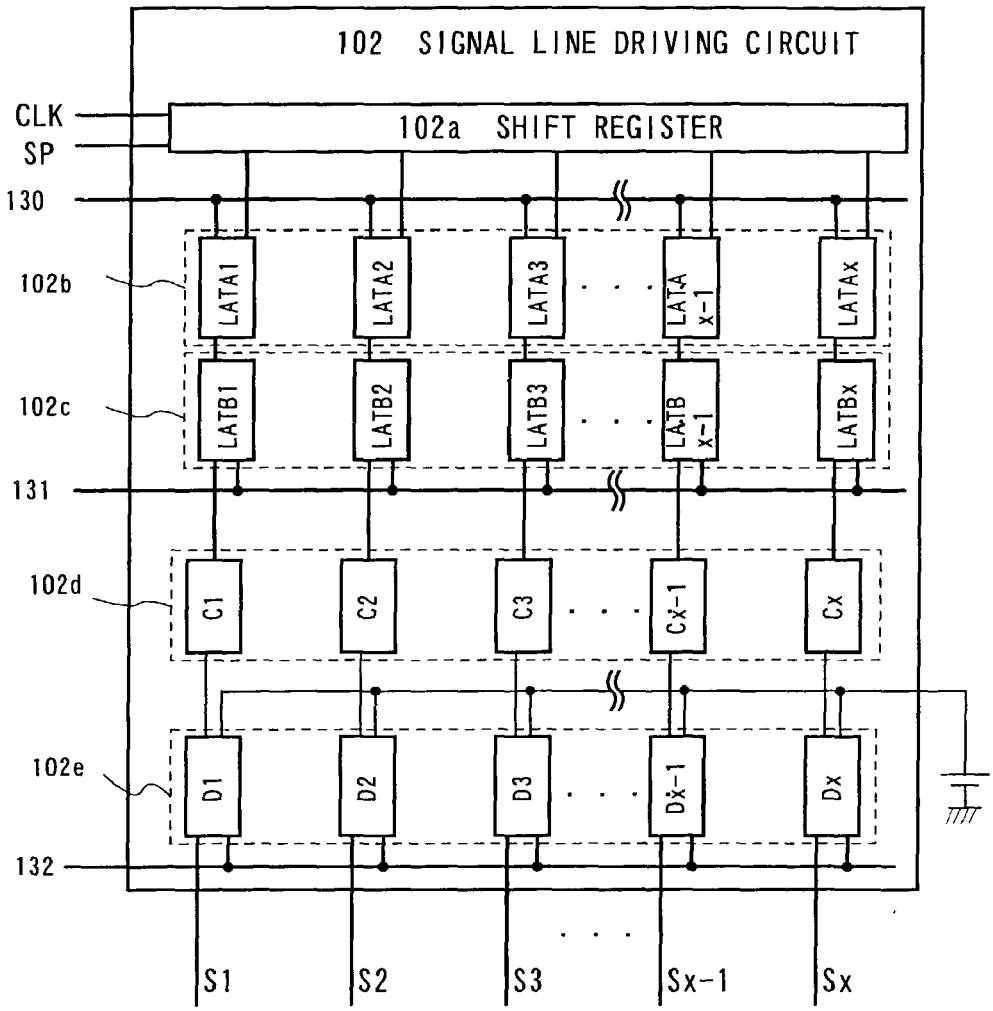
FIG. 9 exemplifies a block diagram of a signal line driving circuit according to the present invention.

FIG. 9 exemplifies a schematic block diagram of a signal-line driving circuit 102 utilized for implementing the present invention. Reference numeral 102*a* designates a shift register, 102*b* a memory circuit A, 102*c* a memory circuit B, 102*d* a current converting circuit, and reference numeral 102*e* designates a switching circuit.

A clock signal CLK and a start-up pulse signal SP are input to a shift register 102*a*. Digital video signals are input to a memory circuit A 102*b*, whereas a latch signal is input to another memory circuit B 102*c*. Further, a switching signal is input to a switching circuit 102*e*. Operations of individual circuits are described below in accordance with the flow of signals.

Based on the inputs of the clock signal CLK and the start-up pulse signal SP to the shift register 102*a* via a predetermined wiring route, a timing signal is generated. The timing signal is then delivered to each of a plurality of latches A LATA_1–LATA_x included in a memory circuit A 102*b*. Alternatively, the timing signal generated in the shift register 102*a* may be input to a plurality of latches A LATA_1–LATA_x included in a memory circuit A 102*b* after amplifying the timing signal via a buffering means or the like.

When the memory circuit A 102*b* receives the timing signal, synchronously with the input timing signal, a plurality of digital video signals corresponding to one-bit are serially written into the above-referred plural latches A LATA_1–LATA_x for storage therein before eventually being delivered to a video signal line 130.

In this embodiment, a plurality of digital video signals are serially written into the memory circuit A comprising LATA_1–LATA_x. However, the scope of the present invention is not solely limited to this arrangement. For example, it is also practicable to split plural stages of latches present in the memory circuit A 102*b* into plural groups in order to enable digital video signals to be simultaneously input to each of the individual groups in parallel with each other. This method is referred to as "division drive" for example. The number of the split groups is referred to as the division number. For example, when the latches are split into plural groups of 4-stages, this is referred to as the four-division drive.

A period of time until the completion of a process to serially write plural digital video signals into the all stages of latches present in the memory circuit A 102*b* is called a line period. There is a case in which the line period refers to a period in which a horizontal retracing period is added to the line period.

After terminating one line period, latch signals are delivered to a plurality of latches B LATB_1–LATB_x held in another memory circuit B 102*c* via a latch signal line 131. Simultaneously, a plurality of digital video signals retained by a plurality of latches LATA_1–LATA_x present in the memory circuit A 102*b* are written all at once into a plurality of latches B LATB_1–LATB_x present in the above referred memory circuit B 102*c* for storage therein.

After fully delivering the retained digital video signals to the memory circuit B 102*c*, synchronously with the timing signal fed from the above shift register 102*a*, digital video signals corresponding to the following one bit are serially written into the memory circuit A 102*b*. During the second-round one-line period is underway, digital video signals stored in the memory circuit B 102*c* are delivered to a current converting circuit 102*d*.

The current converting circuit 102*d* comprises a plurality of current setting circuits C1–Cx. Based on the binary data of 1 or 0 of the digital video signals input to each of the current setting circuits C1–Cx, magnitude of signal current Ic of signals to be delivered to the following switching circuit 102*e* is determined. Specifically, the signal current Ic is of such a magnitude just enough to cause a light emitting element to emit light or such a magnitude that does not cause the light emitting element to emit light.

In accordance with a switching signal received from a switching signal line 132, the switching circuit 102*e* determines whether the above signal current IC should be fed to a corresponding signal line or a voltage that would cause the transistor Tr2 to turn ON should be fed to the corresponding signal line.

Figure 10:
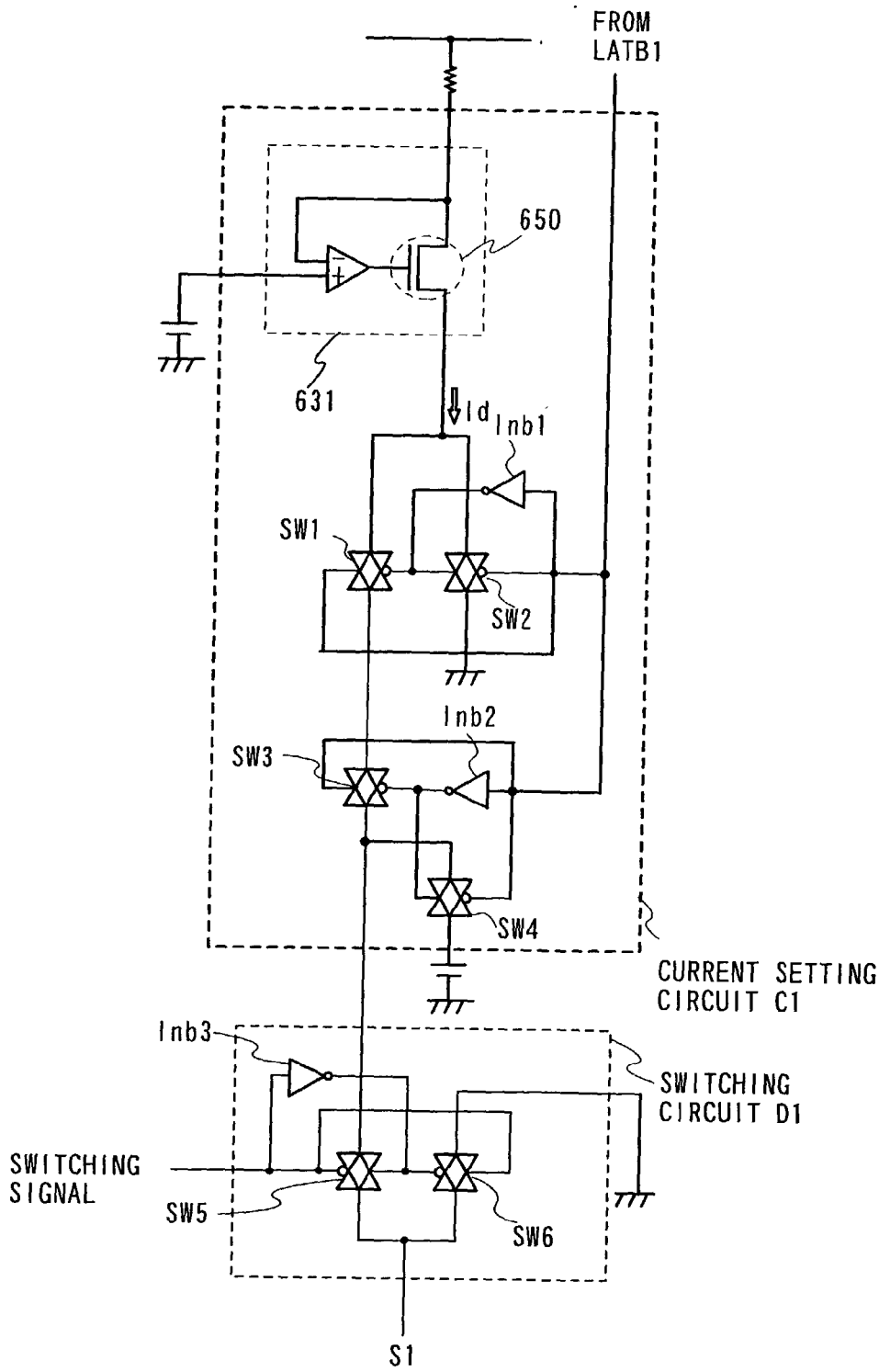
FIG. 10 exemplifies a diagram of a current setting circuit and a switching circuit.

FIG. 10 exemplifies concrete constitutions of the current setting circuit C1 and the switching circuit D1 described above. It should be understood that each of current setting circuits C2–Cx has a constitution identical to that of the above current setting circuit C1. Likewise, each of switching circuits D2–Dx has a constitution identical to that of the switching circuit D1.

The current setting circuit C1 comprises the following: a constant-current supply source 631, four transmission gates SW1–SW4, and a pair of inverters Inb1 and Inb2. It should be noted that polarity of a transistor 650 provided for the constant-current supply source 631 is identical to those of the above-referred transistors Tr1 and Tr2 provided for an individual pixel.

Switching operations of the transmission gates SW1–SW4 are controlled by the digital video signal output from the latch LATB_1 present in the memory circuit B 102*c*. Those digital video signals delivered to the transmission gates SW1 and SW3 and those digital video signals delivered to the transmission gates SW2 and SW4 are respectively inverted by the inverters Inb1 and Inb2. Because of this arrangement, while the transmission gates SW1 and SW3 remain ON, transmission gates SW2 and SW4 are turned OFF, and vice versa.

While the transmission gates SW1 and SW3 remain ON, current Id of a predetermined value other than 0 is fed from the constant-current supply source 631 to the switching circuit D1 as signal current Ic via the transmission gates SW1 and SW3.

Conversely, while the transmission gates SW2 and SW4 are held ON, current Id output from the constant-current supply source 631 is grounded via the transmission gate SW2. Further, power supply voltage flowing through power supply lines V1–Vx is applied to the switching circuit D1 via the transmission gate SW4, thereby entering into a condition where IC≈0

The switching circuit D1 comprises a pair of transmission gates SW5 and SW6 and an inverter Inb3. Switching operations of the transmission gates SW5 and SW6 are controlled by switching signals. Polarities of the switching signals respectively fed to the transmission gates SW5 and SW6 are inverted with respect to each other by the inverter Inb3, and thus, while the transmission gate SW5 remains ON, the other date SW6 remains OFF, and vice versa. While the transmission gate SW5 remains ON, the above signal current Ic is delivered to the signal line S1. While the transmission gate SW6 remains ON, a voltage sufficient to turn ON the above transistor Tr2 is fed to the signal line S1.

Referring to FIG. 9 again, the above serial processes are simultaneously executed within one-line period in all the current setting circuits C1–Cx present in the current converting circuit 102*d*. As a result, actual value of the signal current Ic to be delivered to all the signal lines is selected by the corresponding digital video signals.

Constitution of the driving circuit used for embodying the present invention is not solely limited to those which are cited in the above description. Further, the current converting circuit exemplified in the above description is not solely limited to the structure shown in FIG. 10. Insofar as the current converting circuit utilized for the present invention is capable of enabling digital video signals to be used to select either of binary values that the signal current Ic may take and then feeding a signal current bearing the selected value to a signal line, any constitution may be employed therefor. Further, insofar as a switching circuit can select either to feed signal current Ic to a signal line or to deliver a certain voltage sufficient to turn ON the transistor Tr2 to the signal line, any constitution may also be employed for the switching circuit in addition to that shown in FIG. 10.

In place of a shift register, it is also practicable to utilize a different circuit like a decoder circuit capable of selecting any of signal lines.

Next, constitution of a scanning line driving circuit is described below.

Figure 11:
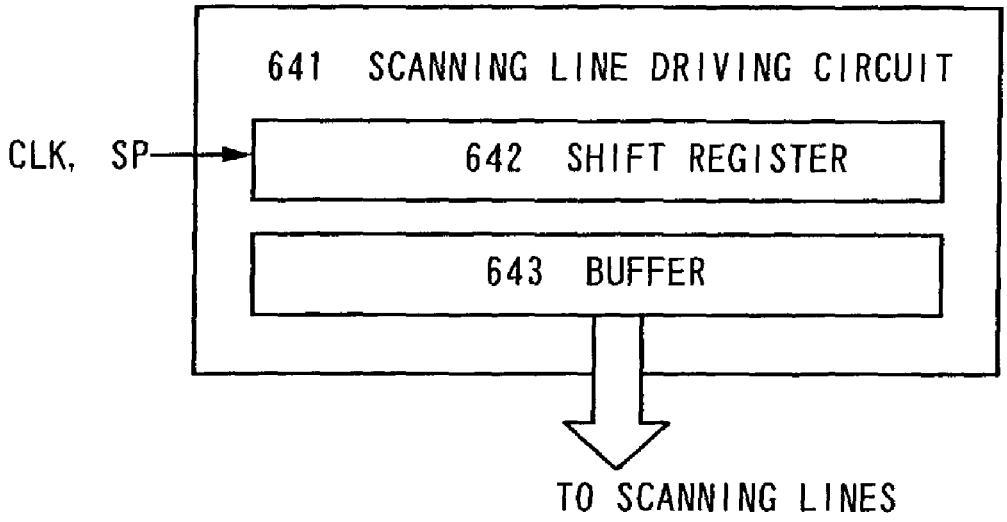
FIG. 11 exemplifies a block diagram of a scanning line driving circuit.

FIG. 11 exemplifies a block diagram of a scanning line driving circuit 641 comprising a shift register 642 and a buffer circuit 643. If deemed necessary, a level shifter may also be provided.

In the scanning line driving circuit 641, upon the input of a clock signal CLK and a start-up pulse signal SP, a timing signal is generated. The generated timing signal is buffered and amplified by the buffer circuit 643 and then delivered to a corresponding scanning line.

A plurality of gates of those transistors composing pixels corresponding one-line are connected to individual scanning lines. Since it is required to simultaneously turn ON a plurality of transistors included in pixels corresponding to one line, the buffer circuit 643 is capable of accommodating flow of a large current.

It should be noted that constitution of the scanning line driving circuit 641 provided for the light emitting device of the present invention is not solely limited to the one shown in FIG. 11. For example, in place of the above-referred shift register, it is also practicable to utilize a different circuit like a decoder circuit capable of selecting any of scanning lines.

The constitution based on this embodiment may also be realized by being freely combined with Embodiments 1 to 4.

[Embodiment 6]

The following description refers to the constitution of a signal-line driving circuit provided for the light emitting device of the present invention, which is driven by an analog drive method. Since the scanning line driving circuit in this embodiment utilizes the constitution shown in the preceding embodiment, further description is omitted.

Figure 12:
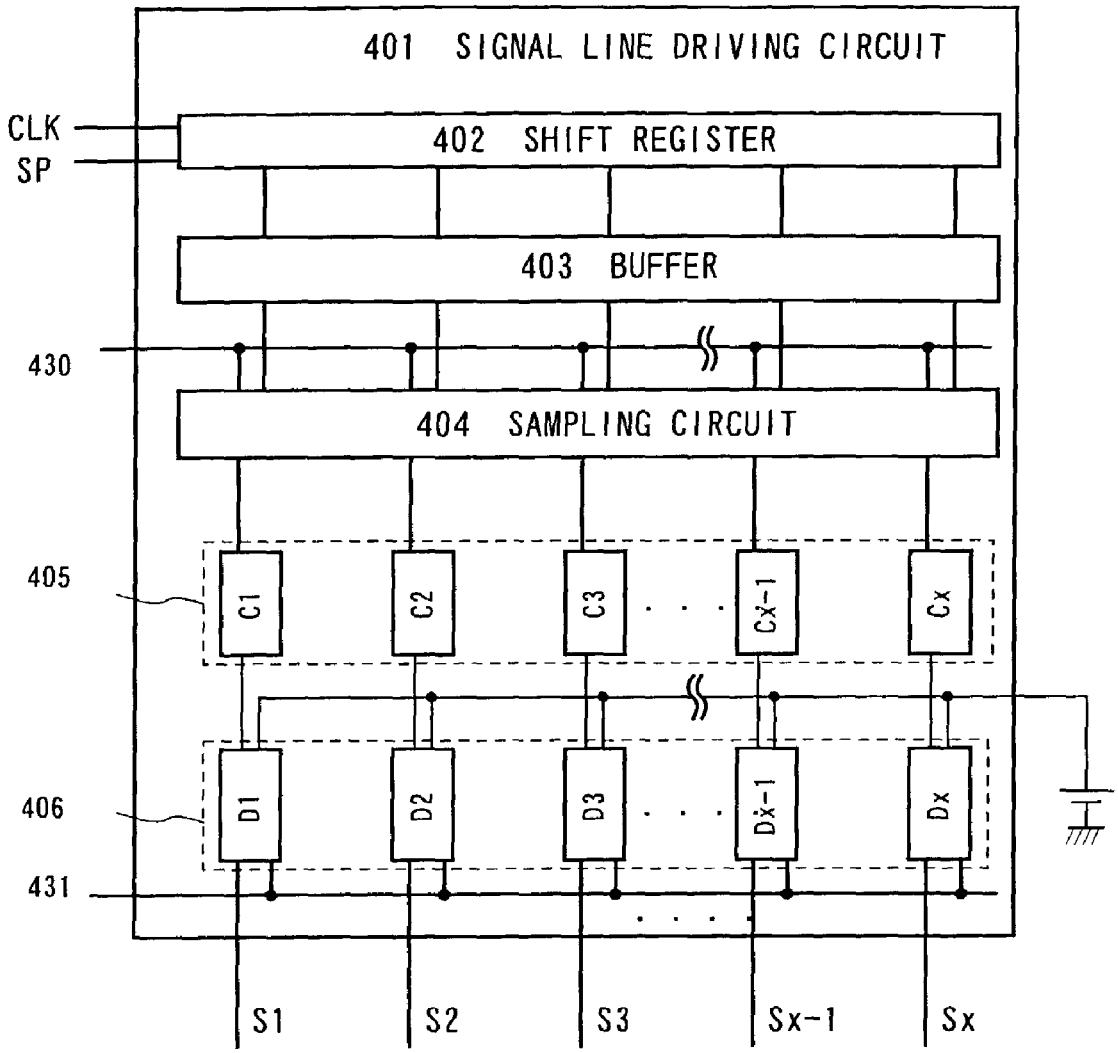
FIG. 12 exemplifies a block diagram of the signal line driving circuit according to the present invention.

FIG. 12 exemplifies a schematic block diagram of a signal-line driving circuit 401 utilized for implementing the present invention. Reference numeral 402 designates a shift register, 403 a buffer circuit, 404 a sampling circuit, 405 a current converting circuit, and reference numeral 406 designates a switching circuit.

A clock signal CLK and a start-up pulse signal SP are input to the shift register 402. Upon the input of the clock signal CLK and the start-up pulse signal SP into the shift register 402, a timing signal is generated.

The generated timing signal is amplified or buffered and amplified by the buffer circuit 403 and then input to the sampling circuit 404. It is also practicable to replace the buffer circuit 404 with a level shifter to amplify the timing signal. Alternatively, both the buffer circuit and the level shifter may be provided.

Next, synchronously with the timing signal, the sampling circuit 404 delivers analog video signals fed from a video signal line 430 to the current converting circuit 405 located at the subsequent stage.

The current converting circuit 405 generates a signal current Ic of a magnitude corresponding to a voltage of the input analog video signal and then delivers the generated signal current Ic to the following switching circuit 406. The switching circuit 406 selects either to deliver the signal current Ic to the signal line or to deliver a voltage that would cause the transistor Tr2 to turn ON, the signal line.

Figure 13:
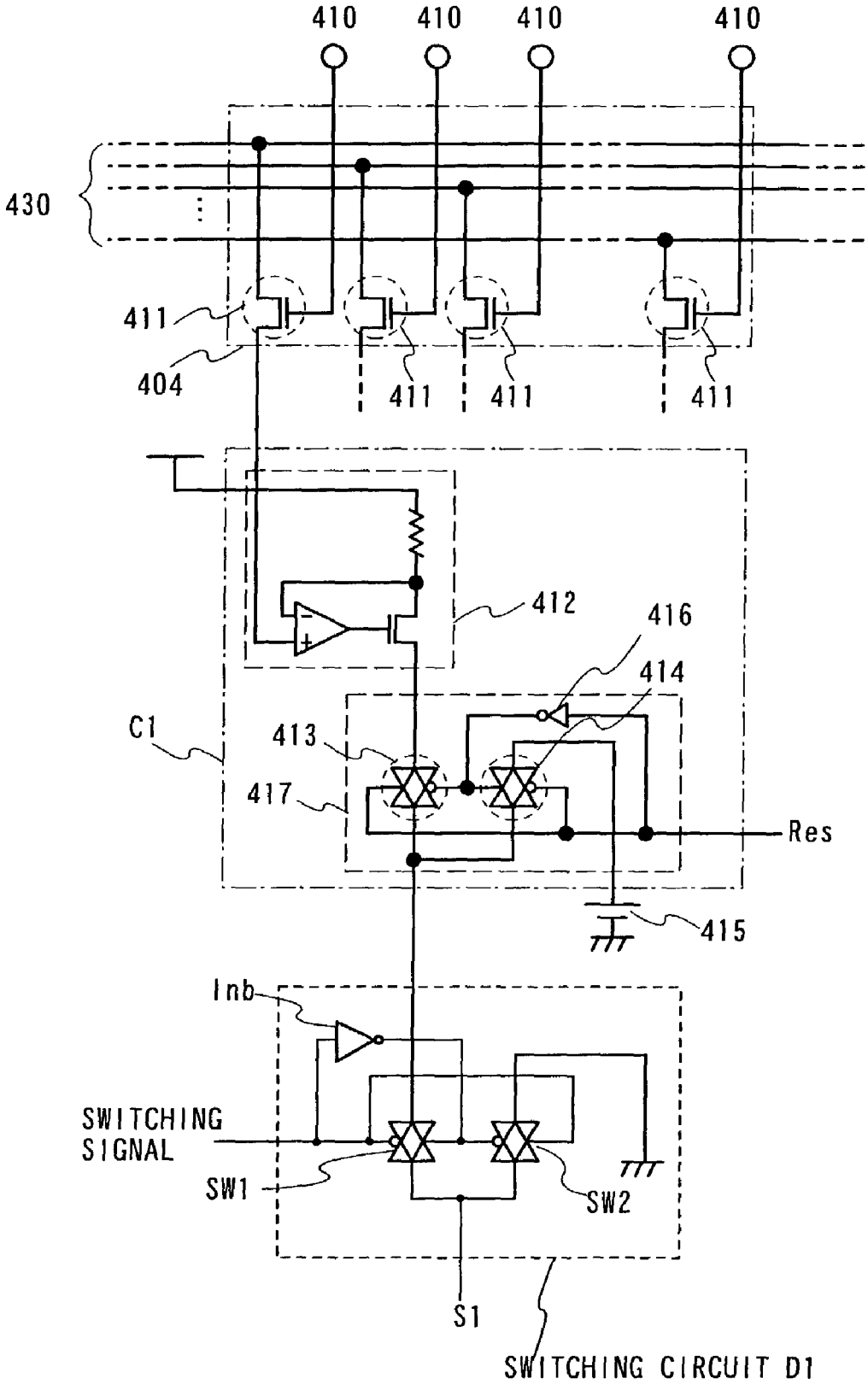
FIG. 13 exemplifies a diagram of another current setting circuit and another switching circuit.

FIG. 13 shows concrete constitutions of the sampling circuit 404 and a plurality of current setting circuits C1–Cx provided for the current converting circuit 405. The sampling circuit 404 is connected to the buffer circuit 403 via a terminal 410.

The sampling circuit 404 is provided with a plurality of switches 411. The sampling circuit 404 receives analog video signals fed from a video signal line 430. Synchronously with the timing signal, the switches 411 individually sample the input analog video signals and then deliver the sampled analog video signals to the current setting circuit C1 located at the subsequent stage. It should be noted that FIG. 13 solely exemplifies the current setting circuit C1 connected to one of the switches 411 built in the sampling circuit 404 among the above-referred current setting circuits C1–Cx. However, it is assumed that the current setting circuit C1 shown in FIG. 13 is connected to each of the individual switches 411 at their subsequent stages provided for the sampling circuit 404.

In this embodiment, only one transistor is utilized for an individual switch 411. It should be understood that, however, insofar as analog video signal can properly be sampled synchronously with the timing signal, there is no restriction on the constitution of the switches 411 described above.

The sampled analog video signals are then input to a current output circuit 412 provided for the current setting circuit C1. The current output circuit 412 outputs a signal current of a value corresponding to the voltage borne by the input analog video signals. In FIG. 12, the current output circuit 412 is formed by using an amplifier and a transistor. However, the scope of the present invention is not solely limited to this constitution but any circuit capable of outputting current corresponding to the voltage of the input analog video signal may also be utilized.

The above-referred signal current is delivered to a reset circuit 417 present in the current setting circuit C1, where the reset circuit 417 comprises a pair of transmission gates 413 and 414, and an inverter 416.

A reset signal (Res) is input to the transmission gate 414, whereas the other transmission gate 413 receives a reset signal (Res) inverted by the inverter 416. The transmission gate 413 and the other transmission gate 414 are individually operated synchronously with the inverted reset signal and the rest signal, respectively, and thus, while either of the transmission gates 413 and 414 remains ON, the other remains OFF.

While the transmission gate 413 remains ON, the signal current is delivered to the following switching circuit D1. On the other hand, while the transmission gate 414 remains ON, a voltage of the power supply 415 is delivered to the switching circuit D1 located at the subsequent stage. It is desired that the signal line be reset during the retracing period. However, except for a period during display of pixel, it is also practicable to reset the signal line in such a period other than the retracing period as required.

The switching circuit D1 comprises a pair of transmission gates SW1 and SW2 and an inverter Inb. Switching operations of the transmission gates SW1 and SW2 are controlled by switching signals. Polarities of the switching signals respectively fed to the transmission gates SW1 and SW2 are inverted with respect to each other by the inverter Inb, and thus, while the transmission gate SW1 remains ON, the other date SW2 remains OFF, and vice versa. While the transmission gate SW1 remains ON, the above signal current Ic is delivered to the signal line S1. While the transmission gate SW2 remains ON, a voltage sufficient to turn ON the above transistor Tr2 is fed to the signal line S1.

In place of a shift register, it is also practicable to utilize such a different circuit like a decoder circuit capable of selecting any of signal lines.

Practical constitution of the signal-line driving circuit for driving the light emitting device of the present invention is not solely limited to the one exemplified in this embodiment. The constitution based on this embodiment may also be realized by being freely combined with those constitutions exemplified in the preceding Embodiments 1 to 4.

[Embodiment 7]

In this embodiment, an external light emitting quantum efficiency can be remarkably improved by using an organic light emitting material by which phosphorescence from a triplet excitation can be employed for emitting a light. As a result, the power consumption of light emitting element can be reduced, the lifetime of light emitting element can be elongated and the weight of light emitting element can be lightened.

The following is a report where the external light emitting quantum efficiency is improved by using the triplet excitation (T. Tsutsui, C. Adachi, S. Saito, Photochemical processes in Organized Molecular Systems, ed. K. Honda, (Elsevier Sci. Pub., Tokyo, 1991) p. 437).

The molecular formula of an organic light emitting material (coumarin pigment) reported by the above article is represented as follows.

(Chemical formula 1)

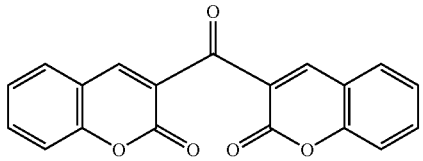

(M. A. Baldo, D. F. O'Brien, Y. You, A. Shoustikov, S. Sibley, M. E. Thompson, S. R. Forrest, Nature 395 (1998) p. 151)

The molecular formula of an organic light emitting material (Pt complex) reported by the above article is represented as follows.

(Chemical formula 2)

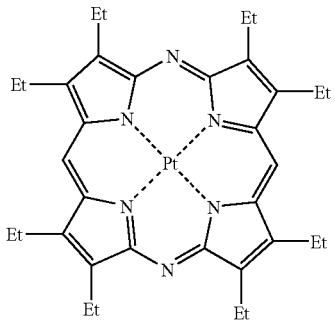

(M. A. Baldo, S. Lamansky, P. E. Burrows, M. E. Thompson, S. R. Forrest, Appl. Phys. Lett., 75 (1999) p. 4.) (T. Tsutsui, M.-J. Yang, M. Yahiro, K. Nakamura, T. Watanabe, T. Tsuji, Y. Fukuda, T. Wakimoto, S. Mayaguchi, Jpn, Appl. Phys., 38 (12B) (1999) L1502)

The molecular formula of an organic light emitting material (Ir complex) reported by the above article is represented as follows.

(Chemical formula 3)

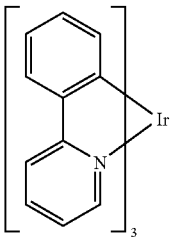

As described above, if phosphorescence from a triplet excitation can be put to practical use, it can realize the external light emitting quantum efficiency three to four times as high as that in the case of using fluorescence from a singlet excitation in principle.

The structure according to this embodiment can be freely implemented in combination of any structures of the Embodiments 1 to 6.

[Embodiment 8]

Organic light emitting materials used in OLEDs are roughly divided into low molecular weight materials and high molecular weight materials. A light-emitting device of the present invention can employ a low molecular weight organic light emitting material and a high molecular weight organic light emitting material both.

A low molecular weight organic light emitting material is formed into a film by evaporation. This makes it easy to form a laminate structure, and the efficiency is increased by layering films of different functions such as a hole transporting layer and an electron transporting layer.

Examples of low molecular weight organic light emitting material include an aluminum complex having quinolinol as a ligand ($Alq_3$) and a triphenylamine derivative (TPD).

On the other hand, a high molecular weight organic light emitting material is physically stronger than a low molecular weight material and enhances the durability of the element. Furthermore, a high molecular weight material can be formed into a film by application and therefore manufacture of the element is relatively easy.

The structure of a light emitting element using a high molecular weight organic light emitting material is basically the same as the structure of a light emitting element using a low molecular weight organic light emitting material, and has a cathode, an organic light emitting layer, and an anode. When an organic light emitting layer is formed from a high molecular weight organic light emitting material, a two-layer structure is popular among the known ones. This is because it is difficult to form a laminate structure using a high molecular weight material unlike the case of using a low molecular weight organic light emitting material. Specifically, an element using a high molecular weight organic light emitting material has a cathode (an Al alloy), a light emitting layer, a hole transporting layer, and an anode (ITO). Ca may be employed as the cathode material in a light emitting element using a high molecular weight organic light emitting material.

The color of light emitted from an element is determined by the material of its light emitting layer. Therefore, a light emitting element that emits light of desired color can be formed by choosing an appropriate material. The high molecular weight organic light emitting material that can be used to form a light emitting layer is a polyparaphenylene vinylene-based material, a polyparaphenylene-based material, a polythiophen-based material, or a polyfluorene-based material.

The polyparaphenylene vinylene-based material is a derivative of poly(paraphenylene vinylene) (denoted by PPV), for example, poly(2,5-dialkoxy-1,4-phenylene vinylene) (denoted by RO-PPV), poly(2-(2'-ethyl-hexoxy)-5-metoxy-1,4-phenylene vinylene) (denoted by MEH-PPV), and poly(2-(dialkoxyphenyl)-1,4-phenylene vinylene) (denoted by ROPh-PPV).

The polyparaphenylene-based material is a derivative of polyparaphenylene (denoted by PPP), for example, poly(2,5-dialkoxy-1,4-phenylene) (denoted by RO-PPP) and poly(2,5-dihexoxy-1,4-phenylene).

The polythiophene-based material is a derivative of polythiophene (denoted by PT), for example, poly(3-alkylthiophene) (denoted by PAT), poly(3-hexylthiophene) (denoted by PHT), poly(3-cyclohexylthiophene) (denoted by PCHT), poly(3-cyclohexyl-4-methylthiophene) (denoted by PCHMT), poly(3,4-dicyclohexylthiophene) (denoted by PDCHT), poly[3-(4-octylphenyl)-thiophene] (denoted by POPT), and poly[3-(4-octylphenyl)-2,2 bithiophene] (denoted by PTOPT).

The polyfluorene-based material is a derivative of polyfluorene (denoted by PF), for example, poly(9,9-dialkylfluorene) (denoted by PDAF) and poly(9,9-dioctylfluorene) (denoted by PDOF).

If a layer that is formed of a high molecular weight organic light emitting material capable of transporting holes is sandwiched between an anode and a high molecular weight organic light emitting material layer that emits light, injection of holes from the anode is improved. This hole transporting material is generally dissolved into water together with an acceptor material, and the solution is applied by spin coating or the like. Since the hole transporting material is insoluble in an organic solvent, the film thereof can form a laminate with the above-mentioned organic light emitting material layer that emits light.

The high molecular weight organic light emitting material capable of transporting holes is obtained by mixing PEDOT with camphor sulfonic acid (denoted by CSA) that serves as the acceptor material. A mixture of polyaniline (denoted by PANI) and polystyrene sulfonic acid (denoted by PSS) that serves as the acceptor material may also be used.

The structure of this embodiment may be freely combined with any of the structures of Embodiments 1 through 7.

[Embodiment 9]

In Embodiment 9, the manufacturing method of the light emitting device of the present invention is described. Note that in Embodiment 9, the manufacturing method of a pixel element illustrated in FIG. 2 is described as an example. Further, although in Embodiment 9, a sectional view of the pixel element having transistors Tr 2 and Tr 3 is illustrated, transistors Tr 1 and Tr 4 also can be manufactured refer to the manufacturing method of Embodiment 9. And, in Embodiment 9, an example in which driving circuits (signal line driving circuit and scanning line driving circuit) provided on the perimeter of a pixel portion having TFTs are formed with TFTs of the pixel portion simultaneously on the same substrate is shown.

Figures 14A, 14B, 14C:
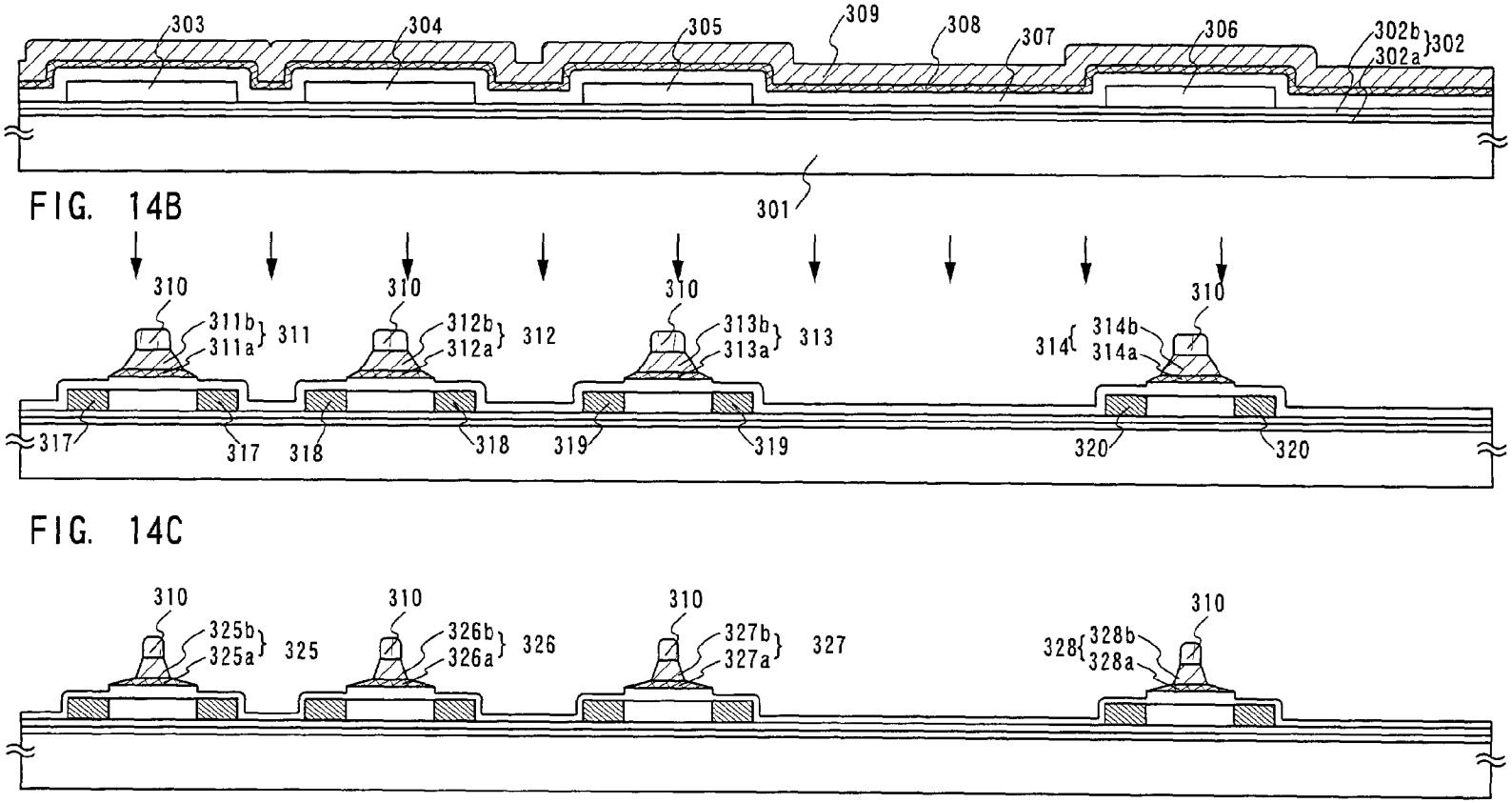
FIGS. 14A to 14C respectively exemplify a method of manufacturing a light emitting device according to the present invention.

First, as shown in FIG. 14A, a base film 302 formed of an insulating film such as a silicon oxide film, a silicon nitride film or a silicon oxynitride film is formed on a substrate 301 formed of glass such as barium borosilicate glass or alumino borosilicate glass represented by #7059 glass and #1737 glass of Coning Corporation. For example, a silicon oxynitride film 302*a* formed from $SiH_4$, $NH_3$ and $N_2O$ by the plasma CVD method and having a thickness of from 10 to 200 nm (preferably 50 to 100 nm) is formed. Similarly, a hydrogenerated silicon oxynitride film formed from $SiH_4$ and $N_2O$ and having a thickness of from 50 to 200 nm (preferably 100 to 150 nm) is layered thereon. In this embodiment, the base film 302 has a two-layer structure, but may also be formed as a single layer film of one of the above insulating films, or a laminate film having more than two layers of the above insulating films.

Island-like semiconductor layers 303 to 306 are formed from a crystalline semiconductor film obtained by conducting laser crystallization method or a known thermal crystallization method on a semiconductor film having an amorphous structure. Each of these island-like semiconductor layers 303 to 306 has a thickness of from 25 to 80 nm (preferably 30 to 60 nm). No limitation is put on the material of the crystalline semiconductor film, but the crystalline semiconductor film is preferably formed from silicon, a silicon germanium (SiGe) alloy, etc.

When the crystalline semiconductor film is to be manufactured by the laser crystallization method, an excimer laser, a YAG laser and an $YVO_4$ laser of a pulse oscillation type or continuous light emitting type are used. When these lasers are used, it is preferable to use a method in which a laser beam radiated from a laser oscillator is converged into a linear shape by an optical system and then is irradiated to the semiconductor film. A crystallization condition is suitably selected by an operator. When the excimer laser is used, pulse oscillation frequency is set to 300 Hz, and laser energy density is set to from 100 to 400 mJ/cm$^2$ (typically 200 to 300 mJ/cm$^2$). When the YAG laser is used, pulse oscillation frequency is preferably set to from 30 to 300 kHz by using its second harmonic, and laser energy density is preferably set to from 300 to 600 mJ/cm$^2$ (typically 350 to 500 mJ/cm$^2$). The laser beam converged into a linear shape and having a width of from 100 to 1000 μm, e.g. 400 μm is, is irradiated to the entire substrate surface. At this time, overlapping ratio of the linear laser beam is set to from 50 to 90%.

Note that, a gas laser or solid state laser of continuous oscillation type or pulse oscillation type can be used. The gas laser such as an excimer laser, Ar laser, Kr laser and the solid state laser such as YAG laser, $YVO_4$ laser, YLF laser, $YAlO_3$ laser, glass laser, ruby laser, alexandrite laser, Ti: sapphire laser can be used as the laser beam. Also, crystals such as YAG laser, $YVO_4$ laser, YLF laser, $YAlO_3$ laser wherein Cr, Nd, Er, Ho, Ce, Co, Ti or Tm is doped can be used as the solid state laser. A basic wave of the lasers is different depending on the materials of doping, therefore a laser beam having a basic wave of approximately 1 μm is obtained. A harmonic corresponding to the basic wave can be obtained by the using non-linear optical elements.

Further, after an infrared laser light emitted from the solid state laser changes to a green laser light by a non linear optical element, an ultraviolet laser light obtained by another non linear optical element can be used.

When a crystallization of an amorphous semiconductor film is conducted, it is preferable that the second harmonic through the fourth harmonic of basic waves is applied by using the solid state laser which is capable of continuous oscillation in order to obtain a crystal in large grain size. Typically, it is preferable that the second harmonic (with a thickness of 532 nm) or the third harmonic (with a thickness of 355 nm) of an Nd: $YVO_4$ laser (basic wave of 1064 nm) is applied. Specifically, laser beams emitted from the continuous oscillation type $YVO_4$ laser with 10 W output is converted into a harmonic by using the non-linear optical elements. Also, a method of emitting a harmonic by applying crystal of $YVO_4$ and the non-linear optical elements into a resonator. Then, more preferably, the laser beams are formed so as to have a rectangular shape or an elliptical shape by an optical system, thereby irradiating a substance to be treated. At this time, the energy density of approximately 0.01 to 100 MW/cm$^2$(preferably 01. to 10 MW/cm$^2$) is required. The semiconductor film is moved at approximately 10 to 2000 cm/s rate relatively corresponding to the laser beams so as to irradiate the semiconductor film.

Next, a gate insulating film 307 covering the island-like semiconductor layers 303 to 306 is formed. The gate insulating film 307 is formed from an insulating film containing silicon and having a thickness of from 40 to 150 nm by using the plasma CVD method or a sputtering method. In this embodiment, the gate insulating film 5007 is formed from a silicon oxynitride film with a thickness of 120 nm. However, the gate insulating film is not limited to such a silicon oxynitride film, but it may be an insulating film containing other silicon and having a single layer or a laminated layer structure. For example, when a silicon oxide film is used, TEOS (Tetraethyl Orthosilicate) and $O_2$ are mixed by the plasma CVD method, the reaction pressure is set to 40 Pa, the substrate temperature is set to from 300 to 400° C., and the high frequency (13.56 MHZ) power density is set to from 0.5 to 0.8 W/cm$^2$ for electric discharge. Thus, the silicon oxide film can be formed by discharge. The silicon oxide film manufactured in this way can then obtain preferable characteristics as the gate insulating film by thermal annealing at from 400 to 500° C.

A first conductive film 308 and a second conductive film 309 for forming a gate electrode are formed on the gate insulating film 307. In this embodiment, the first conductive film 308 having a thickness of from 50 to 100 nm is formed from Ta, and the second conductive film 309 having a thickness of from 100 to 300 nm is formed from W.

The Ta film is formed by a sputtering method, and the target of Ta is sputtered by Ar. In this case, when suitable amounts of Xe and Kr are added to Ar, internal stress of the Ta film is released, and pealing off this film can be prevented. Resistivity of the Ta film of α phase is about 20 μΩcm, and this Ta film can be used for the gate electrode. However, resistivity of the Ta film of β phase is about 180 μΩcm, and is not suitable for the gate electrode. When tantalum nitride having a crystal structure close to that of the α phase of Ta and having a thickness of about 10 to 50 nm is formed in advance as the base for the Ta film to form the Ta film of the α phase, the Ta film of α phase can be easily obtained.

The W film is formed by the sputtering method with W as a target. Further, the W film can be also formed by a thermal CVD method using tungsten hexafluoride ($WF_6$). In any case, it is necessary to reduce resistance to use this film as the gate electrode. It is desirable to set resistivity of the W film to be equal to or smaller than 20 μΩcm. When crystal grains of the W film are increased in size, resistivity of the W film can be reduced. However, when there are many impurity elements such as oxygen, etc. within the W film, crystallization is prevented and resistivity is increased. Accordingly, in the case of the sputtering method, a W-target of 99.9999% or 99.99% in purity is used, and the W film is formed by taking a sufficient care of not mixing impurities from a gaseous phase into the W film time when the film is to be formed. Thus, a resistivity of from 9 to 20 μWcm can be realized.

In this embodiment, the first conductive film 308 is formed from Ta, and the second conductive film 309 is formed from W. However, the present invention is not limited to this case. Each of these conductive films may also be formed from an element selected from Ta, W, Ti, Mo, Al and Cu, or an alloy material or a compound material having these elements as principal components. Further, a semiconductor film represented by a polysilicon film doped with an impurity element such as phosphorus may also be used. Examples of combinations other than those shown in this embodiment include: a combination in which the first conductive film 308 is formed from tantalum nitride (TaN), and the second conductive film 309 is formed from W; a combination in which the first conductive film 308 is formed from tantalum nitride (TaN), and the second conductive film 309 is formed from Al; and a combination in which the first conductive film 308 is formed from tantalum nitride (TaN), and the second conductive film 309 is formed from Cu. (FIG. 14A)

Next, a mask 310 is formed from a resist, and first etching processing for forming an electrode and wiring is performed. In this embodiment, an ICP (Inductively Coupled Plasma) etching method is used, and $CF_4$ and $Cl_2$ are mixed with a gas for etching. RF (13.56 MHZ) power of 500 W is applied to the electrode of coil type at a pressure of 1 Pa so that plasma is generated. RF (13.56 MHZ) of 100 W power is also applied to a substrate side (sample stage), and a substantially negative self bias voltage is applied. When $CF_4$ and $Cl_2$ are mixed, the W film and the Ta film are etched to the same extent.

Under the above etching condition, end portions of a first conductive layer and a second conductive layer are formed into a tapered shape by effects of the bias voltage applied to the substrate side by making the shape of the mask formed from the resist into an appropriate shape. The angle of a taper portion is set to from 15° to 45°. It is preferable to increase an etching time by a ratio of about 10 to 20% so as to perform the etching without leaving the residue on the gate insulating film. Since a selection ratio of a silicon oxynitride film to the W film ranges from 2 to 4 (typically 3), an exposed face of the silicon oxynitride film is etched by about 20 to 50 nm by over-etching processing. Thus, conductive layers 311 to 316 of a first shape (first conductive layers 311*a* to 316*a* and second conductive layers 311*b* to 316*b*) formed of the first and second conductive layers are formed by the first etching processing. A region that is not covered with the conductive layers 311 to 316 of the first shape is etched by about 20 to 50 nm in the gate insulating film 307, so that a thinned region is formed. Further, the surface of mask 310 also etched by the above etching.

Then, an impurity element for giving an n-type conductivity is added by performing first doping processing. A doping method may be either an ion doping method or an ion implantation method. The ion doping method is carried out under the condition that a dose is set to from $1\times10^{13}$ to $5\times10^{14}$ atoms/cm$^2$, and an acceleration voltage is set to from 60 to 100 keV. An element belonging to group 15, typically, phosphorus (P) or arsenic (As) is used as the impurity element for giving the n-type conductivity. However, phosphorus (P) is used here. In this case, the conductive layers 311 to 314 serve as masks with respect to the impurity element for giving the n-type conductivity, and first impurity regions 317 to 320 are formed in a self-aligning manner. The impurity element for giving the n-type conductivity is added to the first impurity regions 317 to 320 in a concentration range from $1\times10^{20}$ to $1\times10^{21}$ atoms/cm$^3$ (FIG. 14B).

Second etching processing is next performed without removing the resist mask 310 as shown in FIG. 14C. A W film is etched selectively by using $CF_4$, $Cl_2$ and $O_2$ as the etching gas. The conductive layers 325 to 328 of a second shape (first conductive layers 325*a* to 328*a* and second conductive layers 325*b* to 328*b*) are formed by the second etching processing. A region of the gate insulating film 307, which is not covered with the conductive layers 325 to 328 of the second shape, is further etched by about 20 to 50 nm so that a thinned region is formed.

An etching reaction in the etching of the W film or the Ta film using the mixed gas of $CF_4$ and $Cl_2$ can be assumed from the vapor pressure of a radical or ion species generated and a reaction product. When the vapor pressures of a fluoride and a chloride of W and Ta are compared, the vapor pressure of $WF_6$ as a fluoride of W is extremely high, and vapor pressures of other $WCl_5$, $TaF_5$ and $TaCl_5$ are approximately equal to each other. Accordingly, both the W film and the Ta film are etched using the mixed gas of $CF_4$ and $Cl_2$. However, when a suitable amount of $O_2$ is added to this mixed gas, $CF_4$ and $O_2$ react and become CO and F so that a large amount of F-radicals or F-ions is generated. As a result, the etching speed of the W film whose fluoride has a high vapor pressure is increased. In contrast to this, the increase in etching speed is relatively small for the Ta film when F is increased. Since Ta is easily oxidized in comparison with W, the surface of the Ta film is oxidized by adding $O_2$. Since no oxide of Ta reacts with fluorine or chloride, the etching speed of the Ta film is further reduced. Accordingly, it is possible to make a difference in etching speed between the W film and the Ta film so that the etching speed of the W film can be set to be higher than that of the Ta film.

Figure 15A:
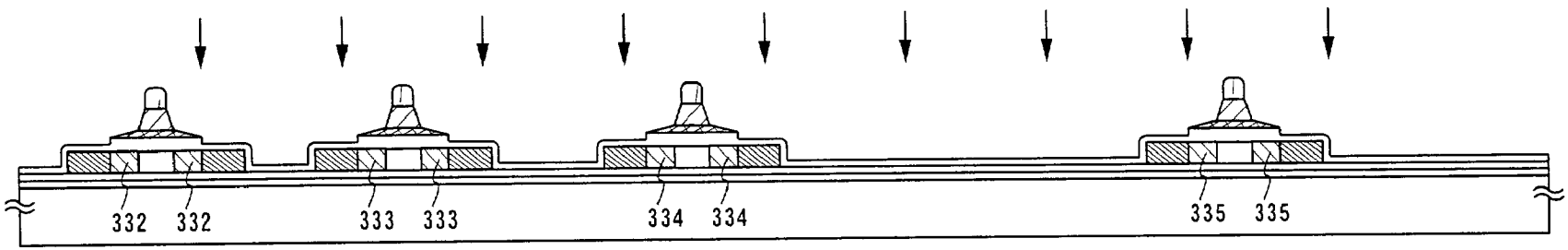
FIGS. 15A to 15C respectively exemplify another method of manufacturing a light emitting device according to the present invention.

As shown in FIG. 15A, second doping processing is then performed. In this case, an impurity element for giving the n-type conductivity is doped in a smaller dose than in the first doping processing and at a high acceleration voltage by reducing a dose lower than that in the first doping processing. For example, the acceleration voltage is set to from 70 to 120 keV, and the dose is set to $1\times10^{13}$ atoms/cm$^2$. Thus, a new impurity region is formed inside the first impurity region formed in the island-like semiconductor layer in FIG. 14B. In the doping, the conductive layers 325 to 328 of the second shape are used as masks with respect to the impurity element, and the doping is performed such that the impurity element is also added to regions underside the first conductive layers 325*a* to 328*a*. Thus, third impurity regions 332 to 335 are formed. The third impurity regions 332 to 335 contain phosphorus (P) with a gentle concentration gradient that conforms with the thickness gradient in the tapered portions of the first conductive layers 325*a* to 328*a*. In the semiconductor layers that overlap the tapered portions of the first conductive layers 325*a* to 328*a*, the impurity concentration is slightly lower around the center than at the edges of the tapered portions of the first conductive layers 325*a* to 328*a*. However, the difference is very slight and almost the same impurity concentration is kept throughout the semiconductor layers.

Figure 15B:
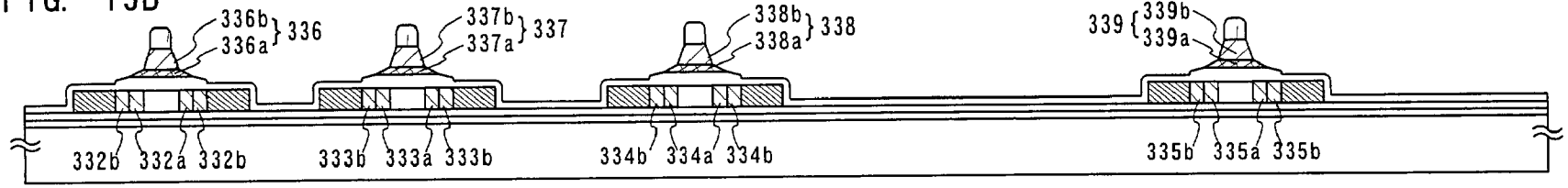

Third etching treatment is then carried out as shown in FIG. 15B. $CHF_6$ is used as etching gas, and reactive ion etching (RIE) is employed. Through the third etching treatment, the tapered portions of the first conductive layers 325*a* to 328*a* are partially etched to reduce the regions where the first conductive layers overlap the semiconductor layers. Thus formed are third shape conductive layers 336 to 339 (first conductive layers 336*a* to 339*a* and second conductive layers 336*b* to 339*b*). At this point, regions of the gate insulating film 307 that are not covered with the third shape conductive layers 336 to 339 are further etched and thinned by about 20 to 50 nm.

Third impurity regions 332 to 335 are formed through the third etching treatment. The third impurity regions 332*a* to 335*a* that overlap the first conductive layers 336*a* to 339*a*, respectively, and second impurity regions 332*b* to 335*b* each formed between a first impurity region and a third impurity region.

Figure 15C:
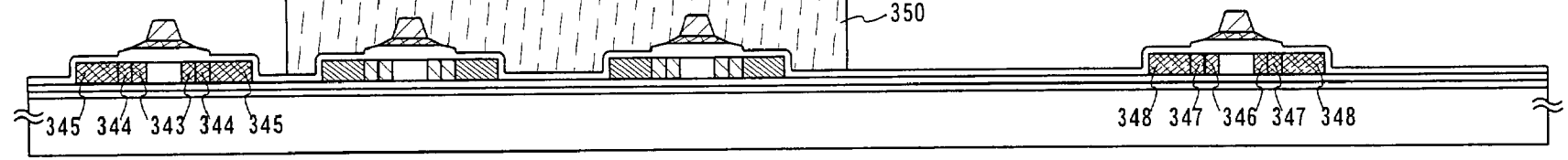

As shown in FIG. 15C, fourth impurity regions 343 to 348 having the opposite conductivity type to the first conductivity type are formed in the island-like semiconductor layers 303 and 306 for forming p-channel type TFTs. The third shape conductive layers 336*b* and 339*b* are used as masks against the impurity element and impurity regions are formed in a self-aligning manner. At this point, the island-like semiconductor layers 304 and 305 for forming n-channel type TFTs are entirely covered with a resist mask 350. The impurity regions 343 to 348 have already been doped with phosphorus in different concentrations. The impurity regions 343 to 348 are doped with diborane ($B^2H_6$) through ion doping and its impurity concentrations are set to form $2\times10^{20}$ to $2\times10^{21}$ atoms/cm$^3$ in the respective impurity regions.

Through the steps above, the impurity regions are formed in the respective island-like semiconductor layers. The third shape conductive layers 336 to 339 overlapping the island-like semiconductor layers function as gate electrodes.

After resist mask 350 is removed, a step of activating the impurity elements added to the island-like semiconductor layers is performed to control the conductivity type. This process is performed by a thermal annealing method using a furnace for furnace annealing. Further, a laser annealing method or a rapid thermal annealing method (RTA method) can be applied. In the thermal annealing method, this process is performed at a temperature of from 400 to 700° C., typically from 500 to 600° C. within a nitrogen atmosphere in which oxygen concentration is equal to or smaller than 1 ppm and is preferably equal to or smaller than 0.1 ppm. In this embodiment, heat treatment is performed for four hours at a temperature of 500° C. When a wiring material used in the third shape conductive layers 336 to 339 is weak against heat, it is preferable to perform activation after an interlayer insulating film (having silicon as a principal component) is formed in order to protect wiring, etc.

When the laser annealing method is employed, the laser used in the crystallization can be used. When activation is performed, the moving speed is set as well as the crystallization processing, and the energy density of about 0.01 to 100 MW/cm$^2$ (preferably 0.01 to 10 MW/cm$^2$) is required.

Further, the heat treatment is performed for 1 to 12 hours at a temperature of from 300 to 450° C. within an atmosphere including 3 to 100% of hydrogen so that the island-like semiconductor layer is hydrogenerated. This step is to terminate a dangling bond of the semiconductor layer by hydrogen thermally excited. Plasma hydrogenation (using hydrogen excited by plasma) may also be performed as another measure for hydrogenation.

Figures 16A, 16B:
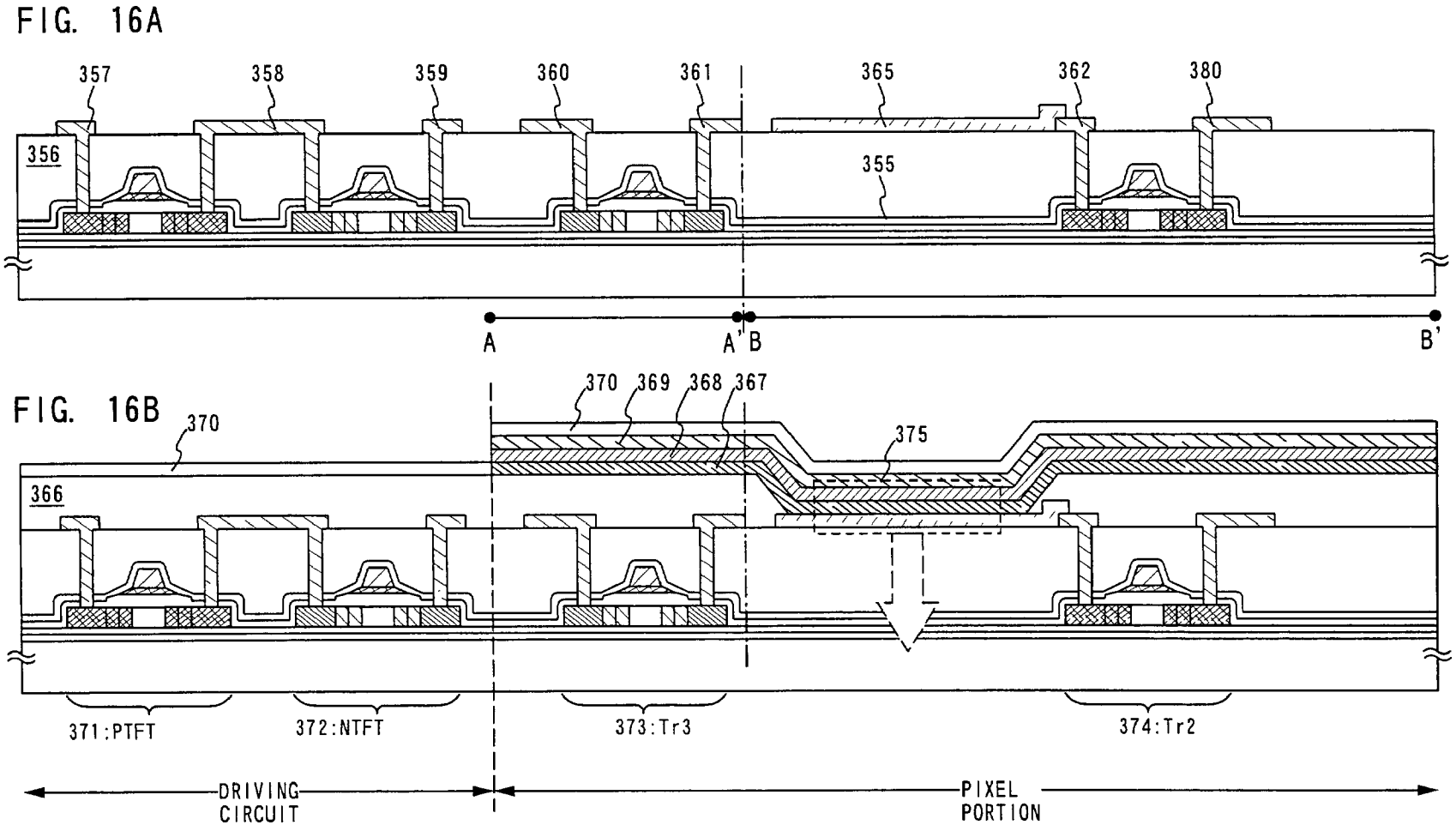
FIGS. 16A and 16B respectively exemplify another method of manufacturing a light emitting device according to the present invention.

Next, as shown in FIG. 16A, a first interlayer insulating film 355 is formed from a silicon oxynitride film with a thickness of 100 to 200 nm. The second interlayer insulating film 356 from an organic insulating material is formed on the first interlayer insulating film. Thereafter, contact holes are formed through the first interlayer insulating film 355, the second interlayer insulating film 356 and the gate insulating film 307, and connecting wirings 357 to 362 and 380 are patterned and formed. Note that reference numeral 380 is a power supply wiring and reference numeral 360 is a signal wiring.

A film having an organic resin as a material is used as the second interlayer insulating film 356. Polyimide, polyamide, acrylic, BCB (benzocyclobutene), etc. can be used as this organic resin. In particular, since the second interlayer insulating film 356 is provided mainly for planarization, acrylic excellent in leveling the film is preferable. In this embodiment, an acrylic film having a thickness that can sufficiently level a level difference caused by the TFT is formed. The film thickness thereof is preferably set to from 1 to 5 μm (is further preferably set to from 2 to 4 μm).

In the formation of the contact holes, contact holes reaching n-type impurity regions 318 and 319 or p-type impurity regions 345 and 348, a contact hole (not illustrated) reaching capacitive wiring (not illustrated) are formed respectively.

Further, a laminate film of a three-layer structure is patterned in a desired shape and is used as connecting wirings 357 to 362 and 380. In this three-layer structure, a Ti film with a thickness of 100 nm, an aluminum film containing Ti with a thickness of 300 nm, and a Ti film with a thickness of 150 nm are continuously formed by the sputtering method. Of course, another conductive film may also be used.

The pixel electrode 365 connected to the connecting wiring (connecting wiring) 362 is formed by patterning.

In this embodiment, an ITO film of 110 nm in thickness is formed as a pixel electrode 365, and is patterned. Contact is made by arranging the pixel electrode 365 such that this pixel electrode 365 comes in contact with the connecting electrode 362 and is overlapped with this connecting wiring 362. Further, a transparent conductive film provided by mixing 2 to 20% of zinc oxide (ZnO) with indium oxide may also be used. This pixel electrode 365 becomes an anode of the OLED element (FIG. 16A).

Figure 17:
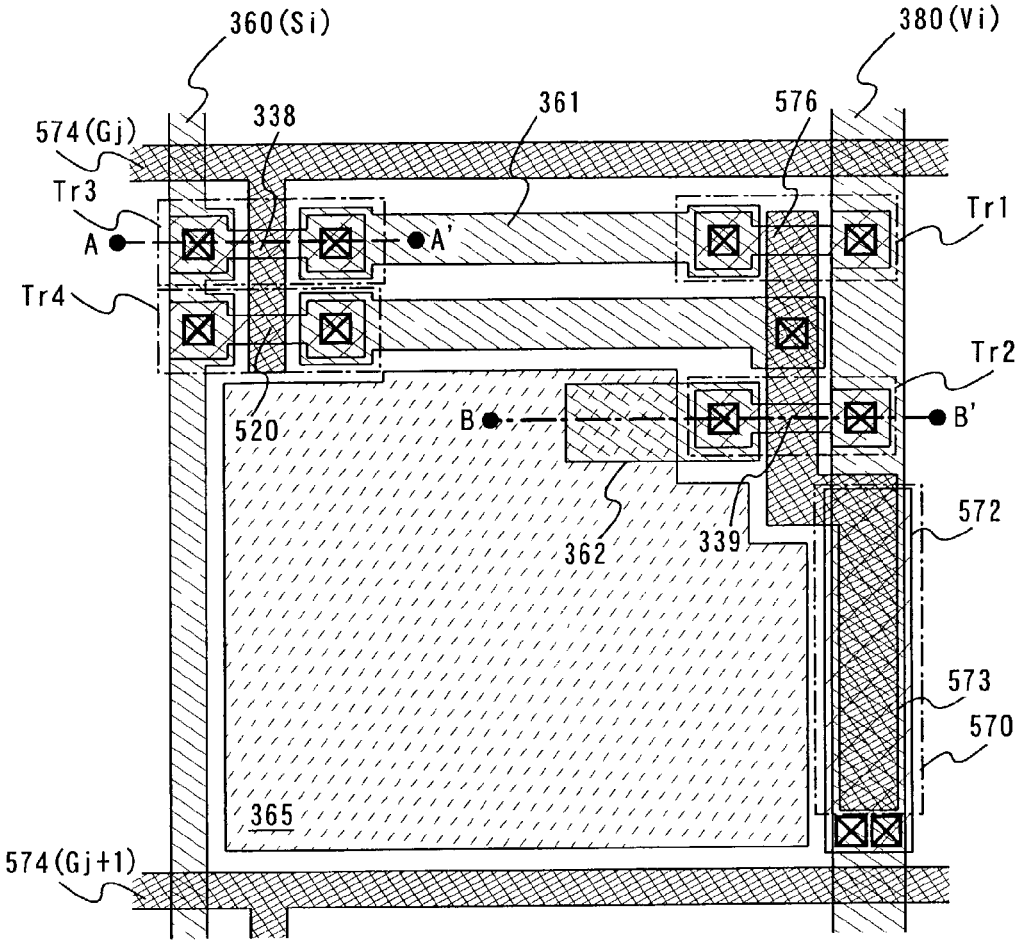
FIG. 17 exemplifies a plan view of a pixel built in a light emitting device according to the present invention.

FIG. 17 shows a top view of the pixels in the point which ends up to the step as shown in FIG. 16A. Incidentally, the explanation about the insulating film and the interlayer insulating film is omitted in order to clarify the position of the wirings and the semiconductor layers. A sectional view taken along a line A–A' in FIG. 17 corresponds to the portion taken along a line A–A' in FIG. 16A. A sectional view taken along a line B–B' in FIG. 17 corresponds to the potion taken along a line B–B' in FIG. 16A.

Transistor Tr3 comprises a gate electrode 338 which is a part of scanning line 574, and the gate electrode 338 is connected to a gate electrode 520 of transistor Tr4. Further, one of an impurity region 317 of semiconductor layer of transistor Tr3 is connected to a connecting wiring 360 functioning as a signal line Si, while the other is connected to a connecting wiring 361.

Transistor Tr2 comprises a gate electrode 339 which is a part of capacitive wiring 573, and the gate electrode 339 is connected to a gate electrode 576 of transistor Tr1. Further, one of an impurity region 348 of semiconductor layer of transistor Tr2 is connected to the connecting wiring 362, while the other is connected to the connecting wiring 361 functioning as power supply Vi.

The connecting wiring 361 is connected to an impurity region of transistor Tr1 (not illustrated). Reference numeral 570 is a storage capacitor having a semiconductor layer 572, a gate insulting film 307 and a capacitive line 573. The impurity region of the semiconductor layer 572 is connected to the connecting wiring 361.

As shown in FIG. 16B, an insulating film (a silicon oxide film in this embodiment) containing silicon and having a thickness of 500 nm is next formed. A third interlayer insulating film 366 functions as a bank is formed in which an opening is formed in a position corresponding to the pixel electrode 365. When the opening is formed, a side wall of the opening can easily be tapered by using the wet etching method. When the side wall of the opening is not gentle enough, deterioration of an organic light emitting layer caused by a level difference becomes a notable problem.

Next, an organic light emitting layer 367 and a cathode (MgAg electrode) 368 are continuously formed by using the vacuum evaporation method without exposing to the atmosphere. The organic light emitting layer 367 has a thickness of from 80 to 200 nm (typically from 100 to 120 nm), and the cathode 368 has a thickness of from 180 to 300 nm (typically from 200 to 250 nm).

In this process, the organic light emitting layer is sequentially formed with respect to a pixel corresponding to red, a pixel corresponding to green and a pixel corresponding to blue. In this case, since the organic light emitting layer has an insufficient resistance against a solution, the organic light emitting layer must be formed separately for each color instead of using a photolithography technique. Therefore, it is preferable to cover a portion except for desired pixels using a metal mask so that the organic light emitting layer is formed selectively only in a required portion.

Namely, a mask for covering all portions except for the pixel corresponding to red is first set, and the organic light emitting layer for emitting red light are selectively formed by using this mask. Next, a mask for covering all portions except for the pixel corresponding to green is set, and the organic light emitting layer for emitting green light are selectively formed by using this mask. Next, a mask for covering all portions except for the pixel corresponding to blue is similarly set, and the organic light emitting layer for emitting blue light are selectively formed by using this mask. Here, different masks are used, but instead the same single mask may be used repeatedly.

Here, a system for forming three kinds of OLED element corresponding to RGB is used. However, a system in which an OLED element for emitting white light and a color filter are combined, a system in which the OLED element for emitting blue or blue green light is combined with a fluorescent substance (a fluorescent color converting medium: CCM), a system for overlapping the OLED elements respectively corresponding to R, G, and B with the cathodes (opposite electrodes) by utilizing a transparent electrode, etc. may be used.

A known material can be used as the organic light emitting layer 367. An organic material is preferably used as the known material in consideration of a driving voltage. For example, a four-layer structure consisting of a hole injection layer, a hole transportation layer, a light emitting layer and an electron injection layer is preferably used for the organic light emitting layer.

Next, the cathode 368 is formed. This embodiment uses MgAg for the cathode 368 but it is not limited thereto. Other known materials may be used for the cathode 368.

The overlapping portion, which is comprised of the pixel electrode 365, the organic light-emitting layer 367 and the cathode 368, corresponds to OLED 375.

Next, the protective electrode 369 is formed by an evaporation method. The protective electrode 369 may be formed in succession forming the cathode 368 without exposing the device to the atmosphere. The protective electrode 369 has an effect on protect the organic light-emitting layer 367 from moisture and oxygen.

The protective electrode 369 also prevents degradation of the cathode 368. A typical material of the protective electrode is a metal film mainly containing aluminum. Other material may of course be used. Since the organic light-emitting layer 367 and the cathode 368 are extremely weak against moisture, the organic light-emitting layer 367, the cathode 368, and the protective electrode 369 are desirably formed in succession without exposing them to the atmosphere. It is preferable to protect the organic light-emitting layer from the outside atmosphere.

Lastly, a passivation film 370 is formed from a silicon nitride film with a thickness of 300 nm. The passivation film 370 protects the organic compound layer 367 from moisture and the like, thereby further enhancing the reliability of the OLED. However, the passivation film 370 may not necessarily be formed.

A light-emitting device structured as shown in FIG. 16B is thus completed. Reference symbol 371 denotes p-channel TFT of the driving circuit, 372, n-channel TFT of driving circuit, 373, the transistor Tr4, and 374, the transistor Tr2.

The light-emitting device of this embodiment exhibits very high reliability and improved operation characteristics owing to placing optimally structured TFTs in not only the pixel portion but also in the driving circuits. In the crystallization step, the film may be doped with a metal catalyst such as Ni to enhance the crystallinity. By enhancing the crystallinity, the drive frequency of the signal line driving circuit can be set to 10 MHZ or higher.

In practice, the device reaching the state of FIG. 16B is packaged (enclosed) using a protective film that is highly airtight and allows little gas to transmit (such as a laminate film and a UV-curable resin film) or a light-transmissive seal, so as to further avoid exposure to the outside atmosphere. A space inside the seal may be set to an inert atmosphere or a hygroscopic substance (barium oxide, for example) may be placed there to improve the reliability of the OLED.

After securing the airtightness through packaging or other processing, a connector is attached for connecting an external signal terminal with a terminal led out from the elements or circuits formed on the substrate.

By following the process shown in this embodiment, the number of photo masks needed in manufacturing a light-emitting device can be reduced. As a result, the process is cut short to reduce the manufacture cost and improve the yield.

The structure of this embodiment may be freely combined with any of the structures of Embodiments 1 to 8.

[Embodiment 10]

Figure 18:
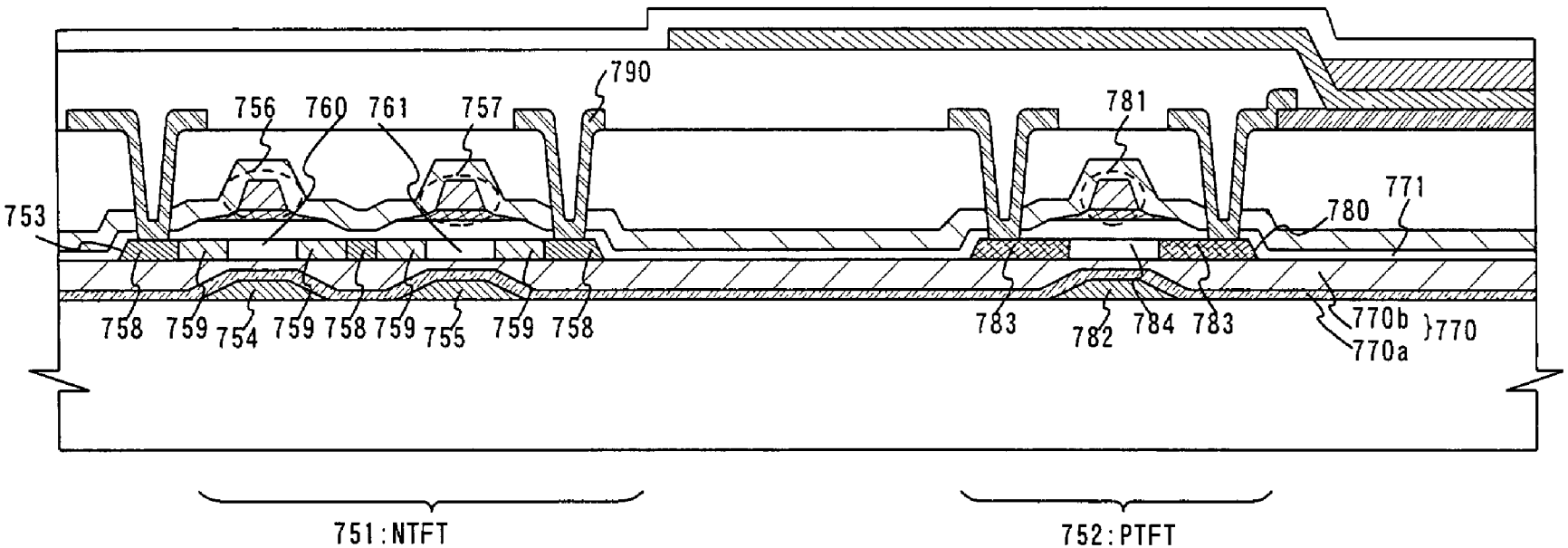
FIG. 18 exemplifies a cross-sectional view of a pixel built in the light emitting device according to the present invention.

In this embodiment, in addition to the one shown in the preceding embodiment 9, a still another constitution of a pixel of a light emitting device being one of the semiconductor devices of the present invention is described below. FIG. 18 shows a cross-sectional view of a pixel built in a light emitting device according to this embodiment. For simplifying the related illustration, transistors Tr1 and Tr4 are omitted. However, constitutions identical to those for the transistors Tr2 and Tr3 may be employed therefor.

Referring to FIG. 18, reference numeral 751 designates an n-channel type TFT corresponding to the transistor Tr3 shown in FIG. 2. Reference numeral 752 denotes a p-channel type TFT corresponding to the transistor Tr2 shown in FIG. 2. The n-channel type TFT 752 comprises a semiconductor film 753, a first insulating film 770, a pair of first electrodes 754 and 755, a second insulating film 771, and a pair of second electrodes 756 and 757. The semiconductor film 753 comprises a one-conductivity-type impurity region 758 having a first impurity concentration, a one-conductivity-type impurity region 759 having a second impurity concentration, and a pair of channel forming regions 760 and 761.

In this embodiment, the first insulating film 770 consists of a pair of laminated insulating films 770*a* and 770*b*. Alternatively, it is also practicable to provide the first insulating film 770 composed of a single-layer insulating film or an insulating film comprising three or more laminated layers.

A pair of the channel forming regions 760 and 761 oppose a pair of the first electrodes 754 and 755 through the first insulating film 770 arrange therebetween. The other channel forming regions 760 and 761 are also superposed on a pair of the second electrodes 756 and 757 by way of sandwiching the second insulating film 771 in-between.

The p-channel type TFT 752 comprises a semiconductor film 780, a first insulating film 770, a first electrode 782, a second insulating film 771, and a second electrode 781. The semiconductor film 780 comprises a one-conductivity-type impurity region 783 having a third impurity concentration, and a channel forming region 784.

The channel forming region 784 and the first electrode 782 oppose each other through the first insulating film 770. Further, the channel forming region 784 and the second electrode 781 also oppose each other through the second insulating film 771 arranged therebetween.

In this embodiment, although not shown in FIG. 18, a pair of the first electrodes 754 and 755 and a pair of the second electrodes 756 and 757 are electrically connected to each other. It should be noted that the scope of the present invention is not solely limited to the above connecting relationship, but it is also practicable to realize such a constitution in which the first electrodes 754 and 755 are electrically disconnected from the second electrodes 756 and 757 and are applied with a predetermined voltage. Alternatively, it is also possible to realize such a constitution in which the first electrode 782 is electrically disconnected from the second electrode 781 and is applied with a predetermined voltage.

Compared to the case of utilizing only one electrode, by applying a predetermined voltage to the first electrode 782, potential variation of the threshold value can be prevented from occurring, and yet, OFF-current can be suppressed. Further, by applying the same voltage to the first and second electrodes, in the same way as in the case of substantially reducing thickness of the semiconductor film, depletion layer quickly spreads, thus making it possible to minimize sub-threshold coefficient and further improve the field-effect mobility. Accordingly, compared to the case of utilizing one electrode, it is possible to increase value of an ON current. Further, by employing the above-referred TFTs based on the above-described constitutions, it is possible to lower the drive voltage. Further, since it is possible to increase the value of an ON current, it is possible to contract the actual size, in particular, the channel width, of the TFTs, it is possible to increase the integration density.

The structure of this embodiment may be freely combined with any of the structures of Embodiments 1 to 8.

[Embodiment 11]

Figure 19:
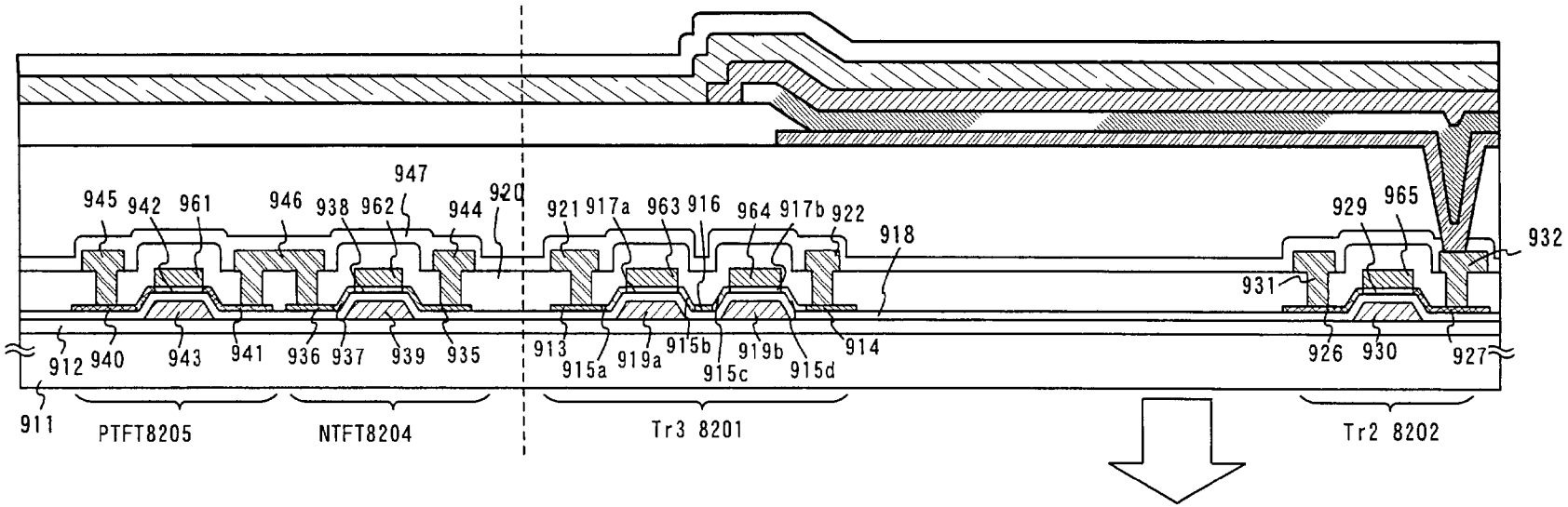
FIG. 19 exemplifies another cross-sectional view of a pixel built in the light emitting device according to the present invention.

In Embodiment 11, the different structure of the pixels of the light emitting device which is one example of the semiconductor device according to the present invention from that described in Embodiments 9 and 10 is described. FIG. 19 is a sectional view of the pixels of a light emitting device in Embodiment 11. Although, for ease of explanation, Tr1 and Tr4 are not shown in Embodiment 11, the same structure as Tr3 and Tr2 can be used.

Reference numeral 911 denotes a substrate in FIG. 19, and reference numeral 912 denotes an insulating film which becomes a base (hereafter referred to as a base film). A light transmitting substrate, typically a glass substrate, a quartz substrate, a glass ceramic substrate, or a crystalline glass substrate can be used as the substrate 911. However, the substrate used must be one able to withstand the highest process temperature during the manufacturing processes.

Reference numeral 8201 denotes Tr3, reference numeral 8202 denotes Tr2, and both are formed by n-channel TFT and p-channel TFTs respectively. When the direction of organic light emitting layer is toward the substrate lower side (surface where TFTs and the organic light emitting layer are not formed), the above structure is preferable. However, Tr2 and Tr3 may be either n-channel TFTs or p-channel TFTs.

The Tr3 8201 has an active layer containing a source region 913, a drain region 914, LDD regions 915*a* to 915*d*, a separation region 916, and an active layer including channel regions 917*a* and 917*b*, a gate insulating film 918, gate electrodes 919*a* and 919*b*, a first interlayer insulating film 920, a source signal line 921 and a drain wiring 922. Note that the gate insulating film 918 and the first interlayer insulating film 920 may be common among all TFTs on the substrate, or may differ depending upon the circuit or the element.

Furthermore, the Tr3 8201 shown in FIG. 19 is electrically connected to the gate electrodes 917*a* and 917*b*, becoming namely a double gate structure. Not only the double gate structure, but also a multi-gate structure (a structure containing an active layer having two or more channel regions connected in series) such as a triple gate structure, may of course also be used.

The multi-gate structure is extremely effective in reducing the off current, and provided that the off current of the switching TFT is sufficiently lowered, a capacitor connected to the gate electrode of the Tr2 8202 can be have its capacitance reduced to the minimum necessary. Namely, the surface area of the capacitor can be made smaller, and therefore using the multi-gate structure is also effective in expanding the effective light emitting surface area of the organic light emitting elements.

In addition, the LDD regions 915*a* to 915*d* are formed so as not to overlap the gate electrodes 919*a* and 919*b* through the gate insulating film 918 in the Tr3 8201. This type of structure is extremely effective in reducing the off current. Furthermore, the length (width) of the LDD regions 915*a* to 915*d* may be set from 0.5 to 3.5 μm, typically between 2.0 and 2.5 μm. Further, when using a multi-gate structure having two or more gate electrodes, the separation region 916 (a region to which the same impurity element, at the same concentration, as that added to the source region or the drain region, is added) is effective in reducing the off current.

Next, the Tr2 8202 is formed having an active layer containing a source region 926, a drain region 927, and a channel region 929; the gate insulating film 918; a gate electrode 930, the first interlayer insulating film 920; a connecting wiring 931; and a connecting wiring 932. The Tr2 8202 is a p-channel TFT in Embodiment 11.

Incidentally, the gate electrode 930 is a single structure; the gate electrode 930 may be a multi-structure. Further, the connecting wiring 931 of the Tr2 8202 corresponds to the power supply line (not illustrated).

The structures of the TFTs formed within the pixel are explained above, but a driver circuit is also formed simultaneously at this point. A CMOS circuit, which becomes a basic unit for forming the driver circuit, is shown in FIG. 19.

A TFT having a structure in which hot carrier injection is reduced without an excessive drop in the operating speed is used as an n-channel TFT 8204 of the CMOS circuit in FIG. 19. Note that the term driver circuit indicates a source signal line driver circuit and a gate signal line driver circuit here. It is also possible to form other logic circuit (such as a level shifter, an A/D converter, and a signal division circuit).

An active layer of the n-channel TFT 8204 of the CMOS circuit contains a source region 935, a drain region 936, an LDD region 937, and a channel region 938. The LDD region 937 overlaps with a gate electrode 939 through the gate insulating film 918.

Formation of the LDD region 937 on only the drain region 936 side is so as not to have drop the operating speed. Further, it is not necessary to be very concerned about the off current with the n-channel TFT 8204, and it is good to place more importance on the operating speed. Thus, it is desirable that the LDD region 937 is made to completely overlap the gate electrode to decrease a resistance component to a minimum. It is therefore preferable to eliminate so-called offset.

Furthermore, there is almost no need to be concerned with degradation of a p-channel TFT 8205 of the CMOS circuit, due to hot carrier injection, and therefore no LDD region need be formed in particular. Its active layer therefore contains a source region 940, a drain region 941, and a channel region 942, and a gate insulating film 918 and a gate electrode 943 are formed on the active layer. It is also possible, of course, to take measures against hot carrier injection by forming an LDD region similar to that of the n-channel TFT 8204.

The reference numerals 961 to 965 are a mask to form the channel region 942, 938, 917*a*, 917*b*, and 929.

Further, the n-channel TFT 8204 and the p-channel TFT 8205 have source wirings 944 and 945, respectively, on their source regions, through the first interlayer insulating film 920. In addition, the drain regions of the n-channel TFT 8204 and the p-channel TFT 8205 are mutually connected electrically by a drain wiring 946.

The structure of this embodiment may be freely combined with any of the structures of Embodiments 1 to 8.

[Embodiment 12]

The following description on this embodiment refers to the constitution of a pixel utilizing a cathode as a pixel electrode.

Figure 20:
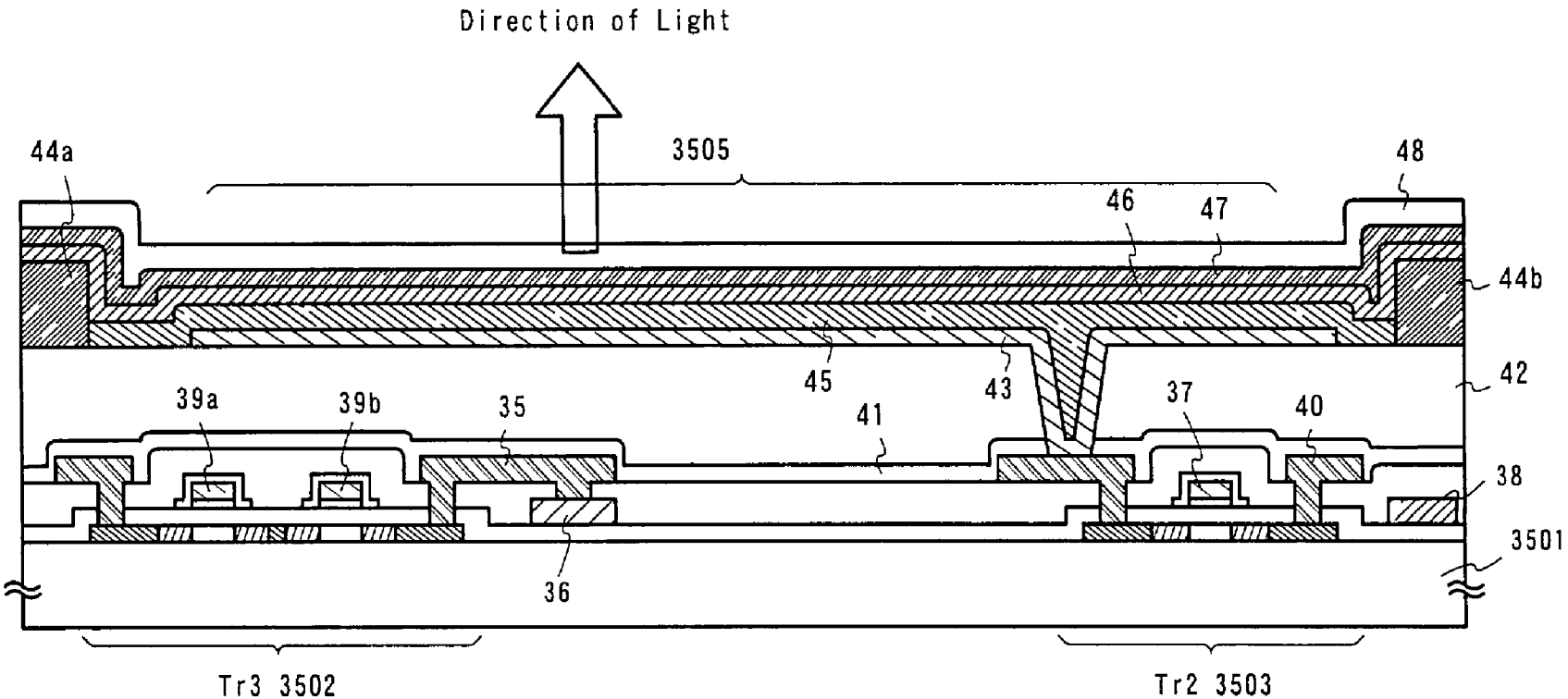
FIG. 20 exemplifies another cross-sectional view of a pixel built in the light emitting device according to the present invention.

FIG. 20 exemplifies a cross-sectional view of a pixel according to this embodiment. In FIG. 20, a transistor Tr3 3502 formed on a substrate 3501 is manufactured by applying a conventional method. In this embodiment, a transistor Tr3 3502 based on the double-gate construction is used. However, it is also practicable to employ a single-gate construction, or a triple-gate construction, or a multiple-gate construction incorporating more than three of gate electrodes. To simplify the illustration, transistors Tr1 and Tr4 are omitted. However, constructions identical to those used for the transistors Tr2 and Tr3 may be employed therefor.

A transistor Tr2 3503 shown in FIG. 20 is an n-channel type TFT, which can be manufactured by applying a known method. A wiring designated by reference numeral 38 corresponds to a scanning line for electrically linking a gate electrode 39*a* of the above transistor Tr3-3502 with the other gate electrode 39*b* thereof.

In this embodiment shown in FIG. 20, the above transistor Tr2 3503 is exemplified as having a single-gate construction. However, the transistor Tr2 3503 may have a multiple-gate construction in which a plurality of TFTs are connected in series with each other. Further, such a construction may also be introduced, which substantially splits a channel forming region into plural parts connecting a plurality of TFTs in parallel with each other, thereby enabling them to radiate heat with higher efficiency. This construction is quite effective to cope with thermal degradation of the TFTs.

Further, a connecting wiring 40 is connected to a power-supply line (not shown) to ensure that a constant voltage can always be fed to the wiring 40.

A first inter-layer insulating film 41 is formed on the transistors Tr3 3502 and Tr2 3503. Further, a second inter-layer insulating film 42 made of resinous insulating film is formed on the first inter-layer insulating film 41. It is extremely important to fully level off steps produced by provision of TFTs by utilizing the second inter-layer insulating film 42. This is because, since organic light emitting layers to be formed later on are extremely thin, since presence of such steps may cause faulty light emission to occur. Taking this into consideration, before forming the pixel electrode, it is desired that the above-referred steps be leveled off as much as possible so that the organic light emitting layers can be formed on a fully leveled surface.

Reference numeral 43 in FIG. 20 designates a pixel electrode, i.e., a cathode electrode provided for the light emitting element, composed of a highly reflective electrically conductive film. The pixel electrode 43 is electrically connected to the drain region of the transistor Tr2 3503. For the pixel electrode 43, it is desired to use an electrically conductive film having a low resistance value such as an aluminum alloy film, a copper alloy film, or a silver alloy film, or a laminate of these alloy films. It is of course practicable to utilize such a construction that employs a laminate comprising the above-referred alloy films combined with other kinds of metallic films bearing electrical conductivity.

FIG. 20 exemplifies a light emitting layer 45 formed inside of a groove (this corresponds to a pixel) produced between a pair of banks 44*a* and 44*b* which are made from resinous insulating films. Although not shown in FIG. 20, it is also practicable to separately form a plurality of light emitting layers respectively corresponding to three colors of red, green, and blue. Organic light emitting material such as π-conjugate polymer material is utilized to compose the light emitting layers. Typically, available polymer materials include the following: polyparaphenylene vinyl (PPV), polyvinyl carbazol (PVK), and polyfluorene, for example.

There are a wide variety of organic light emitting materials comprising the above-referred PPV. For example, such materials cited in the following publications may be used: H. Shenk, H. Becker, O. Gelsen, E. Kluge, W. Spreitzer "Polymers for Light Emitting Diodes", Euro Display, Proceedings, 1999, pp. 33–37, and such material, set forth in the JP-10-92576 A.

As a specific example of the above-referred light emitting layers, there may be used cyano-polyphenylene-vinylene for composing a layer for emitting red light; polyphenylene-vinylene for composing a layer for emitting green light; and polyphnylene or polyalkylphenylene for composing a layer for emitting blue light. It is suggested that the thickness of an individual light emitting layer shall be defined in a range of from 30 nm to 150 nm, preferably in a range of from 40 nm to 100 nm.

The above description, however, has solely referred to a typical example of organic light emitting materials available for composing light emitting layers, and thus, applicable organic light emitting materials are not necessarily limited to those which are cited above. Thus, organic light emitting layers (layers for enabling light emission as well as movement of carriers therefor) freely combining light emitting layers, charge-transfer layers, and charge-injection layers with each other.

For example, this embodiment has exemplified such a case in which polymer materials are utilized for composing light emitting layers. However, it is also possible to utilize organic light emitting materials comprising low-molecular weight compound, for example. To compose a charge-transfer layer and a charge-injection layer, it is also possible to utilize inorganic materials such as silicon carbide for example. Conventionally known materials may be used as the organic materials and the inorganic materials.

In this embodiment, an organic light emitting layers having a laminate structure are formed, in which a hole injection layer 46 made from polythiophene (PEDOT) or polyaniline (PAni) is formed on the light emitting layer 45. An anode electrode 47 composed of a transparent electrically conductive film is formed on the hole injection layer 46. In the pixel shown in FIG. 20, light generated by the light emitting layers 45 is radiant in the direction of the upper surface of the TFT. Because of this, the anode electrode 47 must be light-permeable. To form a transparent electrically conductive film, a compound comprising indium oxide and tin dioxide or a compound comprising indium oxide and zinc oxide may be utilized. However, since the transparent electrically conductive film is formed after completing formation of the light emitting layer 45 and the hole injection layer 46 both having poor heat-resisting property, it is desired that the anode electrode 47 be formed at a low temperature as possible.

Upon completion of the formation of the anode electrode 47, the light emitting element 3505 is completed. Here, the light emitting element 3505 is provided with the pixel electrode (cathode electrode) 43, the light emitting layers 45, the hole injection layer 46, and the anode electrode 47. Since the area of the pixel electrode 43 substantially coincide with the total area of the pixel, the entire pixel functions itself as a light emitting element. Accordingly, an extremely high light-emitting efficiency is attained in practical use, thereby making it possible to display an image with high luminance.

This embodiment further provides a second passivation film 48 on the anode electrode 47. It is desired that silicon nitride or silicon nitride or silicon oxide be utilized for composing the second passivation film 48. The second passivation film 48 shields the light emitting element 3505 from the external in order to prevent unwanted degradation thereof caused by oxidation of the organic light emitting material and also prevent gas component from leaving the organic light emitting material. By virtue of the above arrangement, reliability of the light emitting device is enhanced furthermore.

As described above, the light emitting device of the present invention shown in FIG. 20 includes pixel portions each having the constitution as exemplified therein. In particular, the light emitting device utilizes the transistor Tr3 with a sufficiently a low OFF current value and the transistor Tr2 capable of fully withstanding injection of heated carriers. Because of these advantageous features, the light emitting device shown in FIG. 20 has enhanced reliability and can display clear image.

Note that the structure of this embodiment can be implemented by being freely combined with the structures shown in Embodiments 1 to 8.

[Embodiment 13]

In Embodiment 13, the constitution of the light emitting device of the present invention is described with FIG. 21.

Figure 21A:
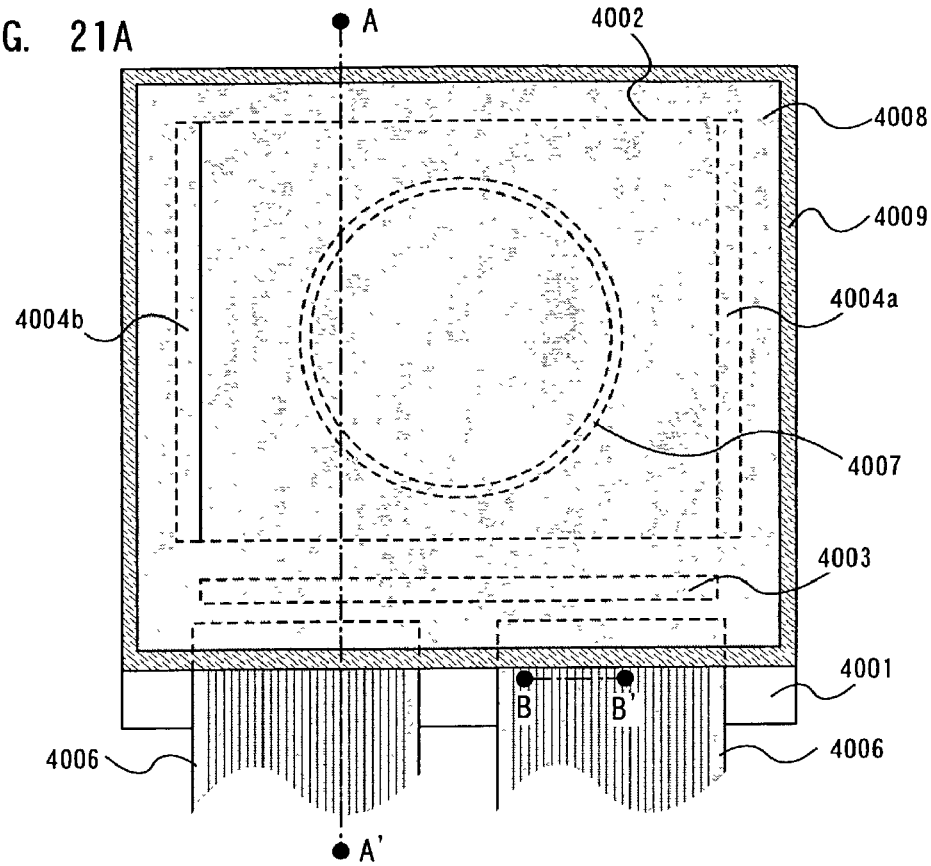
FIGS. 21A to 21C exemplifies an external view and a cross-sectional views of the light emitting device according to the present invention.
Figure 21B:
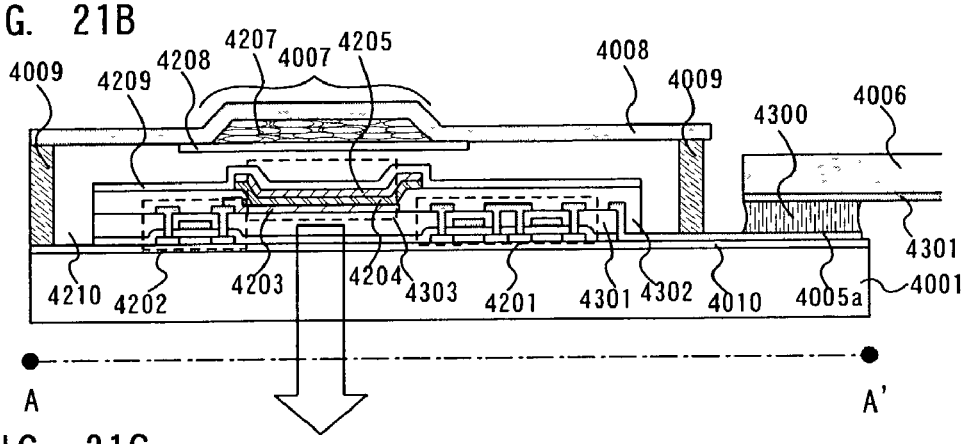
Figure 21C:
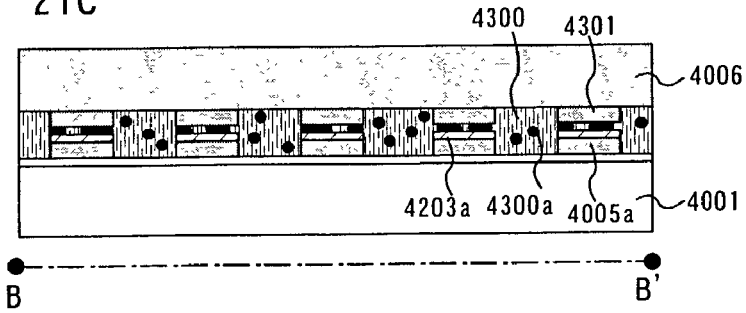

FIG. 21 is a top view of the light-emitting device which is formed according as the element substrate with the transistor is sealed by sealing materials, FIG. 21 B is a cross sectional view taken along with a line A–A' of FIG. 21A, and FIG. 21C is a cross sectional view taken along with a line B–B' of FIG. 21A.

A seal member 4009 is provided so as to surround a pixel portion 4002, a signal line driver circuit 4003, and the first, second scanning line driver circuits 4004*a*, 4004*b*, which are provided on a substrate 4001. Further, a sealing material 4008 is provided on the pixel portion 4002, the signal line driver circuit 4003, and the first, the second scanning line driver circuits 4004*a*, 4004*b*. Thus, the pixel portion 4002, the signal line driver circuit 4003, and the first, the second scanning line driver circuits 4004*a*, 4004*b* are sealed by the substrate 4001, the seal member 4009 and the sealing material 4008 together with a filler 4210.

Further, the pixel portion 4002, the signal line driver circuit 4003, and the first, the second scanning line driver circuits 4004*a*, 4004*b*, which are provided on the substrate 4001, have a plurality of TFTs. In FIG. 21B, a driver circuit TFT (Here, an n-channel TFT and a p-channel TFT are shown in the figure.) 4201 included in the signal line driver circuit 4003 and a transistor Tr2 4202 included in the pixel portion 4002, which are formed on a base film 4010, are typically shown.

In this embodiment, the p-channel TFT or the n-channel TFT manufactured by a known method is used as the driving TFT 4201, and the p-channel TFT manufactured by a known method is used as the transistor Tr2 4202. An interlayer insulating film (leveling film) 4301 is formed on the driving TFT 4201 and the transistor Tr2 4202, and a pixel electrode (anode) 4203 electrically connected to a drain of the transistor Tr2 4202 is formed thereon. A transparent conductive film having a large work function is used for the pixel electrode 4203. A compound of indium oxide and tin oxide, a compound of indium oxide and zinc oxide, zinc oxide, tin oxide or indium oxide can be used for the transparent conductive film. The above transparent conductive film added with gallium may also be used.

Then, an insulating film 4302 is formed on the pixel electrode 4203, and the insulating film 4302 is formed with an opening portion on the pixel electrode 4203. In this opening portion, an organic light-emitting layer 4204 is formed on the pixel electrode 4203. A known organic light-emitting material or inorganic light-emitting material may be used for the organic light-emitting layer 4204. Further, there exist a low molecular weight (monomer) material and a high molecular weight (polymer) material as the organic light-emitting materials, and both the materials may be used.

A known evaporation technique or application technique may be used as a method of forming the organic light-emitting layer 4204. Further, the structure of the organic light-emitting layer may take a lamination structure or a single layer structure by freely combining a hole injecting layer, a hole transporting layer, a light-emitting layer, an electron transporting layer and an electron injecting layer.

A cathode 4205 made of a conductive film having light-shielding property (typically, conductive film containing aluminum, copper or silver as its main constituent or lamination film of the above conductive film and another conductive film) is formed on the organic light-emitting layer 4204. Further, it is desirable that moisture and oxygen that exist on an interface of the cathode 4205 and the organic light-emitting layer 4204 are removed as much as possible. Therefore, such a device is necessary that the organic light-emitting layer 4204 is formed in a nitrogen or rare gas atmosphere, and then, the cathode 4205 is formed without exposure to oxygen and moisture. In this embodiment, the above-described film deposition is enabled by using a multi-chamber type (cluster tool type) film forming device. In addition, a predetermined voltage is given to the cathode 4205.

As described above, an light emitting element 4303 constituted of the pixel electrode (anode) 4203, the organic light-emitting layer 4204 and the cathode 4205 is formed. Further, a protective film 4209 is formed on the insulating film 4302 so as to cover the light emitting element 4303. The protective film 4209 is effective in preventing oxygen, moisture and the like from permeating the light emitting element 4303.

Reference symbol 4005*a* denotes a wiring drawn to be connected to the power supply line, and the wiring 4005*a* is electrically connected to a source region of the transistor Tr2 4202. The drawn wiring 4005*a* passes between the seal member 4009 and the substrate 4001, and is electrically connected to an FPC wiring 4206 of an FPC 4006 through an anisotropic conductive film 4300.

A glass material, a metal material (typically, stainless material), a ceramics material or a plastic material (including a plastic film) can be used for the sealing material 4008. As the plastic material, an FRP (fiberglass-reinforced plastics) plate, a PVF (polyvinyl fluoride) film, a Mylar film, a polyester film or an acrylic resin film may be used. Further, a sheet with a structure in which an aluminum foil is sandwiched with the PVF film or the Mylar film can also be used.

However, in the case where the light from the light emitting element is emitted toward the cover member side, the cover member needs to be transparent. In this case, a transparent substance such as a glass plate, a plastic plate, a polyester film or an acrylic film is used.

Further, in addition to an inert gas such as nitrogen or argon, an ultraviolet curable resin or a thermosetting resin may be used as the filler 4210, so that PVC (polyvinyl chloride), acrylic, polyimide, epoxy resin, silicone resin, PVB (polyvinyl butyral) or EVA (ethylene vinyl acetate) can be used. In this embodiment, nitrogen is used for the filler.

Moreover, a concave portion 4007 is provided on the surface of the sealing material 4008 on the substrate 4001 side, and a hygroscopic substance or a substance that can absorb oxygen 4207 is arranged therein in order that the filler 4210 is made to be exposed to the hygroscopic substance (preferably, barium oxide) or the substance that can absorb oxygen. Then, the hygroscopic substance or the substance that can absorb oxygen 4207 is held in the concave portion 4007 by a concave portion cover member 4208 such that the hygroscopic substance or the substance that can absorb oxygen 4207 is not scattered. Note that the concave portion cover member 4208 has a fine mesh form, and has a structure in which air and moisture are penetrated while the hygroscopic substance or the substance that can absorb oxygen 4207 is not penetrated. The deterioration of the light emitting element 4303 can be suppressed by providing the hygroscopic substance or the substance that can absorb oxygen 4207.

As shown in FIG. 21C, the pixel electrode 4203 is formed, and at the same time, a conductive film 4203*a* is formed so as to contact the drawn wiring 4005*a*.

Further, the anisotropic conductive film 4300 has conductive filler 4300*a*. The conductive film 4203*a* on the substrate 4001 and the FPC wiring 4301 on the FPC 4006 are electrically connected to each other by the conductive filler 4300*a* by heat-pressing the substrate 4001 and the FPC 4006.

Note that the structure of this embodiment can be implemented by being freely combined with the structures shown in Embodiments 1 to 12.

[Embodiment 14]

The light-emitting device using the light emitting element is of the self-emission type, and thus exhibits more excellent recognizability of the displayed image in a light place as compared to the liquid crystal display device. Furthermore, the light-emitting device has a wider viewing angle. Accordingly, the light-emitting device can be applied to a display portion in various electronic devices.

Such electronic devices using a light-emitting device of the present invention include a video camera, a digital camera, a goggles-type display (head mount display), a navigation system, a sound reproduction device (a car audio equipment and an audio set), a lap-top computer, a game machine, a portable information terminal (a mobile computer, a mobile phone, a portable game machine, an electronic book, or the like), an image reproduction apparatus including a recording medium (more specifically, an apparatus which can reproduce a recording medium such as a digital versatile disc (DVD) and so forth, and includes a display for displaying the reproduced image), or the like. In particular, in the case of the portable information terminal, use of the light-emitting device is preferable, since the portable information terminal that is likely to be viewed from a tilted direction is often required to have a wide viewing angle. FIGS. 22A to 22H respectively show various specific examples of such electronic devices.

Figure 22A:
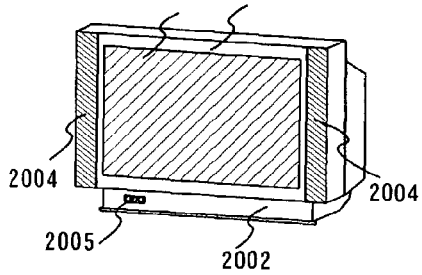
FIGS. 22A to 22H individually exemplify an electronic apparatus utilizing the light emitting device according to the present invention.

FIG. 22A illustrates an light emitting element display device which includes a casing 2001, a support table 2002, a display portion 2003, a speaker portion 2004, a video input terminal 2005 or the like. The present invention is applicable to the display portion 2003. The light-emitting device is of the self-emission-type and therefore requires no backlight. Thus, the display portion thereof can have a thickness thinner than that of the liquid crystal display device. The organic light emitting display device is including the entire display device for displaying information, such as a personal computer, a receiver of TV broadcasting and an advertising display.

Figure 22B:
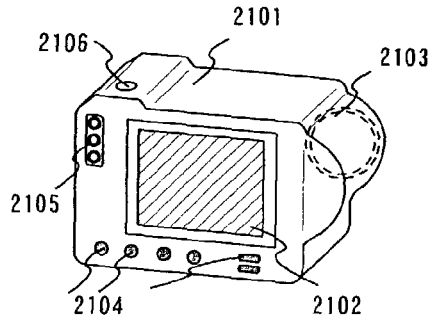

FIG. 22B illustrated a digital still camera which includes a main body 2101, a display portion 2102, an image receiving portion 2103, operation keys 2104, an external connection port 2105, a shutter 2106, or the like. The light-emitting device in accordance with the present invention can be used as the display portion 2102.

Figure 22C:
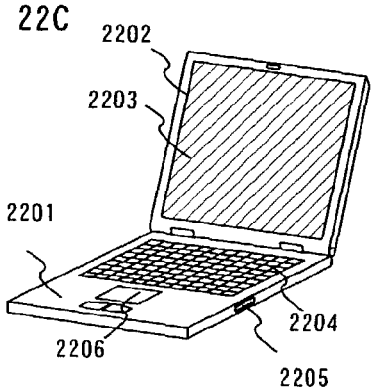

FIG. 22C illustrates a lap-top computer which includes a main body 2201, a casing 2202, a display portion 2203, a keyboard 2204, an external connection port 2205, a pointing mouse 2206, or the like. The light-emitting device in accordance with the present invention can be used as the display portion 2203.

Figure 22D:
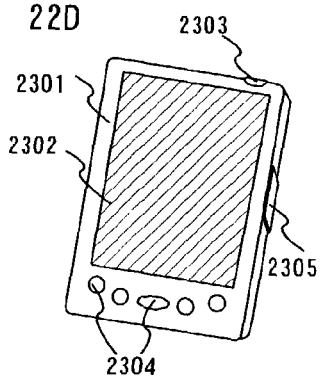

FIG. 22D illustrated a mobile computer which includes a main body 2301, a display portion 2302, a switch 2303, operation keys 2304, an infrared port 2305, or the like. The light-emitting device in accordance with the present invention can be used as the display portion 2302.

Figure 22E:
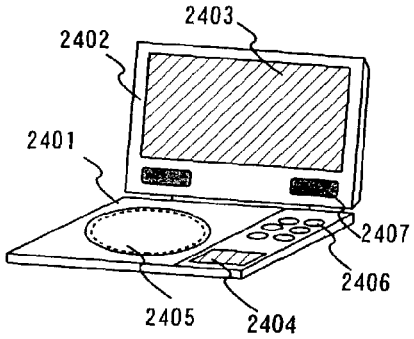

FIG. 22E illustrates a portable image reproduction apparatus including a recording medium (more specifically, a DVD reproduction apparatus), which includes a main body 2401, a casing 2402, a display portion A 2403, another display portion B 2404, a recording medium (DVD or the like) reading portion 2405, operation keys 2406, a speaker portion 2407 or the like. The display portion A 2403 is used mainly for displaying image information, while the display portion B 2404 is used mainly for displaying character information. The light-emitting device in accordance with the present invention can be used as these display portions A 2403 and B 2404. The image reproduction apparatus including a recording medium further includes a game machine or the like.

Figure 22F:
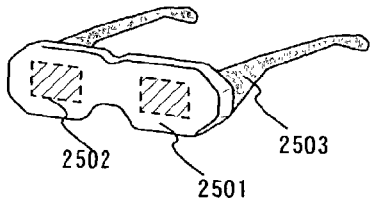

FIG. 22F illustrates a goggle type display (head mounted display) which includes a main body 2501, a display portion 2502, arm portion 2503 or the like. The light-emitting device in accordance with the present invention can be used as the display portion 2502.

Figure 22G:
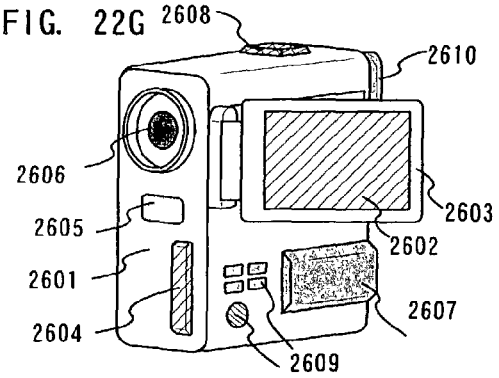

FIG. 22G illustrates a video camera which includes a main body 2601, a display portion 2602, a casing 2603, an external connecting port 2604, a remote control receiving portion 2605, an image receiving portion 2606, a battery 2607, a sound input portion 2608, operation keys 2609, an eyepiece 2610, or the like. The light-emitting device in accordance with the present invention can be used as the display portion 2602.

Figure 22H:
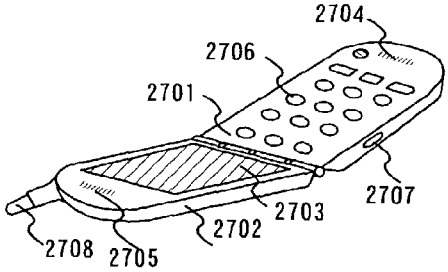

FIG. 22H illustrates a mobile phone which includes a main body 2701, a casing 2702, a display portion 2703, a sound input portion 2704, a sound output portion 2705, operation keys 2706, an external connecting port 2707, an antenna 2708, or the like. The light-emitting device in accordance with the present invention can be used as the display portion 2703. Note that the display portion 2703 can reduce power consumption of the mobile telephone by displaying white-colored characters on a black-colored background.

When the brighter luminance of light emitted from the organic light-emitting material becomes available in the future, the light-emitting device in accordance with the present invention will be applicable to a front-type or rear-type projector in which light including output image information is enlarged by means of lenses or the like to be projected.

The aforementioned electronic devices are more likely to be used for display information distributed through a telecommunication path such as Internet, a CATV (cable television system), and in particular likely to display moving picture information. The light-emitting device is suitable for displaying moving pictures since the organic light-emitting material can exhibit high response speed.

A portion of the light-emitting device that is emitting light consumes power, so it is desirable to display information in such a manner that the light-emitting portion therein becomes as small as possible. Accordingly, when the light-emitting device is applied to a display portion which mainly displays character information, e.g., a display portion of a portable information terminal, and more particular, a portable telephone or a sound reproduction device, it is desirable to drive the light-emitting device so that the character information is formed by a light-emitting portion while a non-emission portion corresponds to the background.

As set forth above, the present invention can be applied variously to a wide range of electronic devices in all fields. The electronic device in this embodiment can be obtained by utilizing a light-emitting device having the structure in which the structures in Embodiments 1 to 9 are freely combined.

According to the light emitting device of the present invention, even when electrical characteristics of individual thin-film transistors vary in each pixel, unlike in a conventional voltage-input type light emitting device, the light emitting device makes it possible to prevent luminance of light emitting elements from varying between individual pixels. Further, as compared with a case in which the thin-film transistors 51 of the conventional voltage-input type pixels shown in FIG. 23 are respectively operated in the linear regions, it is possible with the light emitting device to prevent luminance from being lowered due to degradation of light emitting elements. Further, even when temperature borne by the organic light emitting layer fluctuates due to atmospheric temperature or the heat generated by the light emitting panel itself, it is possible to prevent luminance of light emitting elements from being varied, and it is also possible to prevent current consumption from increasing with the rise of temperature.

Further, by applying an AC-drive method for the light emitting device to which a drive voltage biasing in an inverse direction is applied every predetermined period, it is possible to minimize degradation of current/voltage characteristics of individual light emitting elements, and thus, it is possible to extend actual service life of individual light emitting elements as compared with cases where the conventional drive methods are used.

What is claimed is:

1. A light emitting device comprising: a plurality of pixels individually provided with a light emitting element; and a signal-line driving circuit, wherein:

the signal-line driving circuit comprises:

a first means for generating such current with a magnitude corresponding to that of the voltage of input video signals; and a second means for alternatively selecting one of an operation to feed the generated current to the pixels and an operation to feed a predetermined voltage to the pixels;

each of the plurality of pixels comprises:

a third means for converting the current fed from the first means into a voltage; and a fourth means for feeding the current with a magnitude corresponding to that of the converted voltage to the light emitting element; and the fourth means provides the light emitting element with a voltage biasing in an inverse direction when the predetermined voltage is fed to the pixel.

2. A device according to claim 1, wherein the light emitting device is utilized in electronic equipment.

3. A device according to claim 2, wherein the electronic equipment is selected from the group consisting of a video camera, a digital camera, a goggles-type display, a head mount display, a navigation system, a sound reproduction device, a car audio equipment, an audio set, a lap-top computer, a game machine, a portable information terminal, a mobile computer, a mobile phone, a portable game machine, an electronic book, and an image reproduction apparatus including a recording medium.

4. A light emitting device comprising: a plurality of pixels; and a signal-line driving circuit, wherein:

each of pixels comprises: a first transistor; a second transistor; a third transistor; a fourth transistor; a light emitting element; a power-supply line; a signal line; and a power-supply source for controlling a voltage existing between the power-supply line and an opposing electrode of the light emitting element;

first terminals of the first and second transistors are commonly connected to the power-supply line;

gates of the first and second transistors are connected to each other;

one of a first terminal and a second terminal of the third transistor is connected to the signal line, while the other terminal is connected to a second terminal of the first transistor;

one of a first terminal and a second terminal of the fourth transistor is connected to one of the signal line and the second terminal of the first transistor, while the other terminal is connected to the gates of the first and second transistors; and a second terminal of the second transistor is connected to a pixel electrode of the light emitting element.

5. A device according to claim 4, wherein the light emitting device is utilized in electronic equipment.

6. A device according to claim 5, wherein the electronic equipment is selected from the group consisting of a video camera, a digital camera, a goggles-type display, a head mount display, a navigation system, a sound reproduction device, a car audio equipment, an audio set, a lap-top computer, a game machine, a portable information terminal, a mobile computer, a mobile phone, a portable game machine, an electronic book, and an image reproduction apparatus including a recording medium.

7. A light emitting device comprising: a plurality of pixels; and a signal-line driving circuit, wherein:

the plurality of the pixels individually comprises: a first transistor; a second transistor; a light emitting element; a power-supply line; a signal line; and a power-supply source for controlling a voltage existing between the power-supply line and an opposing electrode of the light emitting element;

the signal-line driving circuit comprises a first means for generating a current with a magnitude corresponding to that of the voltage of input video signals; and a second means for alternatively selecting one of an operation to feed the generated current to the pixels and an operation to feed a predetermined voltage to the pixels;

first terminals of the first and second transistors are commonly connected to the power-supply line;

gates of the first and second transistors are mutually connected to each other;

a second terminal of the second transistor is connected to a pixel electrode of the light emitting element;

in a selected pixel of the plurality of the pixels, the signal line is connected to a second terminal of the first transistor and the gates of the first and second transistors;

the predetermined voltage contains such a magnitude enough to turn the second transistor ON, and when the second transistor is turned ON by the predetermined voltage, the power supply feeds a voltage biasing in an inverse direction to the light emitting element.

8. A device according to claim 7, wherein polarities of the first transistor and the second transistor are identical to each other.

9. A device according to claim 7, wherein:

the first and second transistors individually comprise a first electrode, a first insulating film abutted against the first electrode, an active layer abutted against the first insulating layer, a second insulating film abutted against the active layer, and a second electrode abutted against the second insulating film;

the active layer comprises a channel forming region and a pair of regions doped with impurities being present by way of sandwiching the channel forming region;

the second electrode is superposed on the first electrode by way of mutually sandwiching the first insulating film, the channel forming region, and the second insulating film in-between;

the first electrode is electrically connected from the second electrode; and the first electrode and the second electrode correspond to the gates, and the pair of impurities respectively correspond to a first terminal and a gate.

10. A device according to claim 7, wherein:

the first and second transistors individually comprise a first electrode, a first insulating film abutted against the first electrode, an active layer abutted against the first insulating layer, a second insulating film abutted against the active layer, and a second electrode abutted against the second insulating film;

the active layer comprises a channel forming region and a pair of regions doped with impurities being present by way of sandwiching the channel forming region;

the second electrode is superposed on the first electrode by way of mutually sandwiching the first insulating film, the channel forming region, and the second insulating film in-between;

the first electrode is electrically disconnected from the second electrode; and the second electrode corresponds to the gate, the pair of impurities respectively correspond to a first terminal and a gate.

11. A device according to claim 7, wherein the light emitting device is utilized in electronic equipment.

12. A device according to claim 11, wherein the electronic equipment is selected from the group consisting of a video camera, a digital camera, a goggles-type display, a head mount display, a navigation system, a sound reproduction device, a car audio equipment, an audio set, a lap-top computer, a game machine, a portable information terminal, a mobile computer, a mobile phone, a portable game machine, an electronic book, and an image reproduction apparatus including a recording medium.

13. A light emitting device comprising: a plurality of pixels; and a signal-line driving circuit, wherein:

the plurality of pixels individually comprises: a first transistor; a second transistor; a third transistor; a fourth transistor; a light emitting element; a power-supply line; a signal line; and a power-supply source for controlling a voltage existing between the power-supply line and an opposing electrode of the light emitting element;

the signal-line driving circuit comprises: a first means for generating current with a magnitude corresponding to that of the voltage of input video signals; and a second means for alternatively selecting one of an operation to feed the generated current to the pixels and an operation to feed a predetermined voltage to the pixels;

first terminals of the first and second transistors are commonly connected to the power-supply line;

gates of the first and second transistors are mutually connected to each other;

one of a first terminal and a second terminal of the third transistor is connected to the signal line, while the other terminal is connected to a second terminal of the first transistor;

one of a first terminal and a second terminal of the fourth transistor is connected to one of the signal line and the second terminal of the first transistor, while the other terminal is connected to the gates of the first and second transistors;

a second terminal of the second transistor is connected to a pixel electrode of the light emitting element;

the predetermined voltage contains such a magnitude enough to turn the second transistor ON, and when the second transistor is turned ON by the predetermined voltage, the power supply feeds a voltage biasing in an inverse direction to the light emitting element.

14. A device according to claim 13, wherein polarities of the third transistor and the fourth transistor are identical to each other.

15. A device according to claim 13, wherein:

the third and fourth transistors individually comprise a first electrode, a first insulating film abutted against the first electrode, an active layer abutted against the first insulating layer, a second insulating film abutted against the active layer, and a second electrode abutted against the second insulating film;

the active layer comprises a channel forming region and a pair of such regions doped with impurities being present by way of sandwiching the channel forming region;

the second electrode is superposed on the first electrode by way of mutually sandwiching the first insulating film, the channel forming region, and the second insulating film in-between;

the first electrode is electrically connected from the second electrode; and the first electrode and the second electrode corresponds to the gate, wherein the pair of impurities respectively correspond to a first terminal and a gate.

16. A device according to claim 13, wherein:

the third and fourth transistors individually comprise a first electrode, a first insulating film abutted against the first electrode, an active layer abutted against the first insulating layer, a second insulating film abutted against the active layer, and a second electrode abutted against the second insulating film;

the active layer comprises a channel forming region and a pair of regions doped with impurities being present by way of sandwiching the channel forming region;

the second electrode is superposed on the first electrode by way of mutually sandwiching the first insulating film, the channel forming region, and the second insulating film in-between;

the first electrode is electrically disconnected from the second electrode; and the second electrode corresponds to the gate, and the pair of impurities respectively correspond to a first terminal and a gate.

17. A device according to claim 13, wherein polarities of the first transistor and the second transistor are identical to each other.

18. A device according to claim 13, wherein:

the first and second transistors individually comprise a first electrode, a first insulating film abutted against the first electrode, an active layer abutted against the first insulating layer, a second insulating film abutted against the active layer, and a second electrode abutted against the second insulating film;

the active layer comprises a channel forming region and a pair of regions doped with impurities being present by way of sandwiching the channel forming region;

the second electrode is superposed on the first electrode by way of mutually sandwiching the first insulating film, the channel forming region, and the second insulating film in-between;

the first electrode is electrically connected from the second electrode; and the first electrode and the second electrode correspond to the gates, and the pair of impurities respectively correspond to a first terminal and a gate.

19. A device according to claim 13, wherein:

the first and second transistors individually comprise a first electrode, a first insulating film abutted against the first electrode, an active layer abutted against the first insulating layer, a second insulating film abutted against the active layer, and a second electrode abutted against the second insulating film;

the active layer comprises a channel forming region and a pair of regions doped with impurities being present by way of sandwiching the channel forming region;

the second electrode is superposed on the first electrode by way of mutually sandwiching the first insulating film, the channel forming region, and the second insulating film in-between;

the first electrode is electrically disconnected from the second electrode; and the second electrode corresponds to the gate, the pair of impurities respectively correspond to a first terminal and a gate.

20. A device according to claim 13, wherein the light emitting device is utilized in electronic equipment.

21. A device according to claim 20, wherein the electronic equipment is selected from the group consisting of a video camera, a digital camera, a goggles-type display, a head mount display, a navigation system, a sound reproduction device, a car audio equipment, an audio set, a lap-top computer, a game machine, a portable information terminal, a mobile computer, a mobile phone, a portable game machine, an electronic book, and an image reproduction apparatus including a recording medium.

22. A method of driving a light emitting device including a plurality of pixels individually having a light emitting element, the method comprising;

while a first period is underway, feeding a current determined by video signals to each of the plurality of pixels, and converting the current fed to a first means owned by the pixel into a voltage;

while a second period is underway, feeding the current with a magnitude corresponding to that of the voltage to the light emitting element by a second means owned by the pixel; and while a third period is underway, feeding a predetermined voltage to each of the plurality of pixels, and causing the second means to feed a biasing voltage to the light emitting element, wherein the biasing voltage is a voltage biasing in an inverse direction for the light emitting element.

23. A method of driving a light emitting device including a plurality of pixels individually having a light emitting element, the method comprising;

causing a first period, a second period, and a third period to serially appear during a single-frame period;

while the first period is underway, feeding a current determined by analog video signals to each of the plurality of pixels, and converting the current fed to a first means owned by each of the plurality of pixels into a predetermined voltage;

while the second period is underway, feeding the current with a magnitude corresponding to that of a voltage converted by a second means owned by each of the plurality of pixels to the light emitting element; and while the third period is underway, feeding a predetermined voltage to each of the plurality of pixels; and causing the second means to feed a biasing voltage to the light emitting element, wherein the biasing voltage is a voltage biasing in an inverse direction for the light emitting element.

24. A method of driving a light emitting device including a plurality of pixels individually having a light emitting element, the method comprising;

causing n-units of first periods, n-units of second periods, and a single unit or plural units of third periods (where the first, second, and third periods respectively correspond to individual bits of n-bit of digital video signals) to appear during a single-frame period;

causing the single unit or plural units of the third periods to respectively appear upon termination of any of the different n-units of the second periods;

while the n-units of the first period are individually underway, feeding a current determined by individual bits of the n-bits of digital video signals to each of the pixels, and converting the current fed by a first means owned by the individual pixel into a predetermined voltage;

while the n-units of the second period are individually underway, providing the light emitting element with the current with a magnitude corresponding to a voltage converted by a second means owned by the pixel; and while a unit or plural units of the individual third periods are underway, feeding a predetermined amount of voltage to the pixel, and causing the second means to feed a voltage biasing in an inverse direction to the light emitting element.

25. A method of driving a light emitting device including a plurality of pixels individually having a light emitting element; the method comprising;

causing n-units of first period, n-units of second period (where n-units of the first and second periods individually correspond to individual bits of n-bits of digital video signals), and a unit of third period to respectively appear during a single-frame period;

while the n-units of the first periods are individually underway, feeding a current determined by individual bits of the n-bits of digital video signals to each of the pixels, and converting the current fed by a first means owned by the pixel into a predetermined voltage;

while the n-units of the second periods are individually underway, providing the light emitting element with the current with a magnitude corresponding to a voltage converted by a second means owned by the pixel; and while a unit of the third period is underway, feeding a predetermined voltage to the pixel, and causing the second means to feed a biasing voltage to the light emitting element, wherein the biasing voltage is a voltage biasing in an inverse direction for the light emitting element.

26. A method of driving a light emitting device including a plurality of pixels individually having a light emitting element; the method comprising;

causing n-units of first period, n-units of second period (where n-units of the first and second periods individually correspond to individual bits of n-bits of digital video signals), and a unit of third period to respectively appear during a single-frame period;

while the n-units of the first periods are individually underway, feeding a current determined by individual bits of the n-bits of digital video signals to each of the pixels, and converting the current fed by a first means owned by the pixel into a predetermined voltage;

while the n-units of the second periods are individually underway, providing the light emitting element with the current with a magnitude corresponding to a voltage converted by a second means owned by the pixel; and while a unit of the third period is underway, feeding a predetermined voltage to the pixel, and causing the second means to feed a voltage biasing in an inverse direction to the light emitting element, wherein an absolute value of a product of a total length of duration having the n-units of first period and the n-units of second period and a voltage fed to the light emitting element during the n-units of first period and the n-units of second period, is equal to an absolute value of an product of the length of the third period and the voltage fed to the light emitting element while the third period is underway.

27. A method of driving a light emitting device, in which a first period, a second period, and a third period serially appear while a single-frame period is underway, wherein:

while the first period, the second period, and the third period are serially underway, individual gates of a first transistor and a second transistor owned by the light emitting device are connected to each other, wherein a second terminal of the second transistor is connected to a pixel electrode of a light emitting element;

while the first period is underway, a current determined by individual bits of video signals is made to flow between a first terminal and a second terminal of the first transistor, thereby enabling a gate of the first transistor to be connected to the second terminal of the first transistor, and a first voltage is added to the first terminal of the first transistor and a first terminal of the second transistor;

while the second period is underway, the gate of the first transistor is electrically disconnected from the second terminal of the first transistor, and the first voltage is added to the first terminals of the first and second transistors;

while the third period is underway, the gate of the first transistor is connected to the second terminal of the first transistor, the second transistor is turned ON upon delivery of a second voltage to the gates of the first and second transistors, and a third voltage is added to the first terminals of the first and second transistors; and by referring to a voltage of an opposing electrode of the light emitting element as a standard, polarities of the first voltage and the third voltage are inverse from each other.

28. A method according to claim 27, wherein polarities of the first transistor and the second transistor are identical to each other.

29. A method of driving a light emitting device comprising:

feeding a first current from a current source, determined by individual bits of the n-bits of digital video signals to a pixel, and converting the first current into a first voltage using a first transistor during a first period;

providing a second current to a light emitting element with a magnitude corresponding to the first voltage, using a second transistor during a second period; and feeding a second voltage to the light emitting element during a third period, wherein the second voltage is a voltage biasing in an inverse direction for the light emitting element.

30. A method according to claim 29, wherein an absolute value of a product of a total length of duration having n-units of the first periods and n-units of the second periods and a voltage fed to the light emitting element during the n-units of first period and the n-units of second period, is equal to an absolute value of an product of a length of the third period and the voltage fed to the light emitting element during the third period.

31. A method according to claim 29, wherein one frame period consisting of n-units of the first periods, n-units of the second periods, and a unit of the third period.

* * * * *